US005093981A

United States Patent [19]

Ballard et al.

[11] Patent Number: 5,093,981

[45] Date of Patent: Mar. 10, 1992

[54] METHOD FOR MAKING A TRANSFORMER CORE COMPRISING AMORPHOUS METAL STRIPS SURROUNDING THE CORE WINDOW

[75] Inventors: Donald E. Ballard, Conover; Willi Klappert, Hickory, both of N.C.

[73] Assignee: General Electric Company, King of Prussia, Pa.

[21] Appl. No.: 463,697

[22] Filed: Jan. 11, 1990

[51] Int. Cl.[5] ..... H01F 41/02

[52] U.S. Cl. ..... 29/609; 336/213; 336/234

[58] Field of Search ..... 29/606, 605, 609, 738; 336/212, 213, 216, 217, 234

[56] References Cited

U.S. PATENT DOCUMENTS

| | | | |
|---|---|---|---|
| 3,003,225 | 10/1961 | Zinsky et al. | 29/155.61 |
| 3,049,793 | 8/1962 | Cooper et al. | 29/155.57 |
| 4,024,486 | 5/1977 | Klappert | 336/210 |
| 4,413,406 | 11/1983 | Bennett et al. | 29/609 |
| 4,709,471 | 12/1987 | Valencic et al. | 29/605 |
| 4,734,975 | 4/1988 | Ballard et al. | 29/606 |
| 4,741,096 | 5/1988 | Lee et al. | 29/605 |

*Primary Examiner*—Carl E. Hall

*Attorney, Agent, or Firm*—Henry J. Policiniski; William Freedman

[57] ABSTRACT

This method of making a transformer core from strips of amorphous metal utilizes an arbor that has a longitudinal axis and an external surface surrounding the axis that includes a portion of concave configuration forming a depression in the external surface. A plurality of packets are assembled, each packet comprising a plurality of groups of amorphous metal strips, the groups in each packet (i) comprising many aligned amorphous metal strips and (ii) having transversely-extending edges that are staggered with respect to each other longitudinally of the packet. The packets are sequentially wrapped about the arbor in superposed relationship while the arbor is held against rotation, thereby building up a core form about the arbor. Each packet prior to its being wrapped about the arbor is located so that when wrapped, opposite ends of each group meet in overlapping relationship in a location angularly aligned with said surface portion of concave configuration.

65 Claims, 10 Drawing Sheets

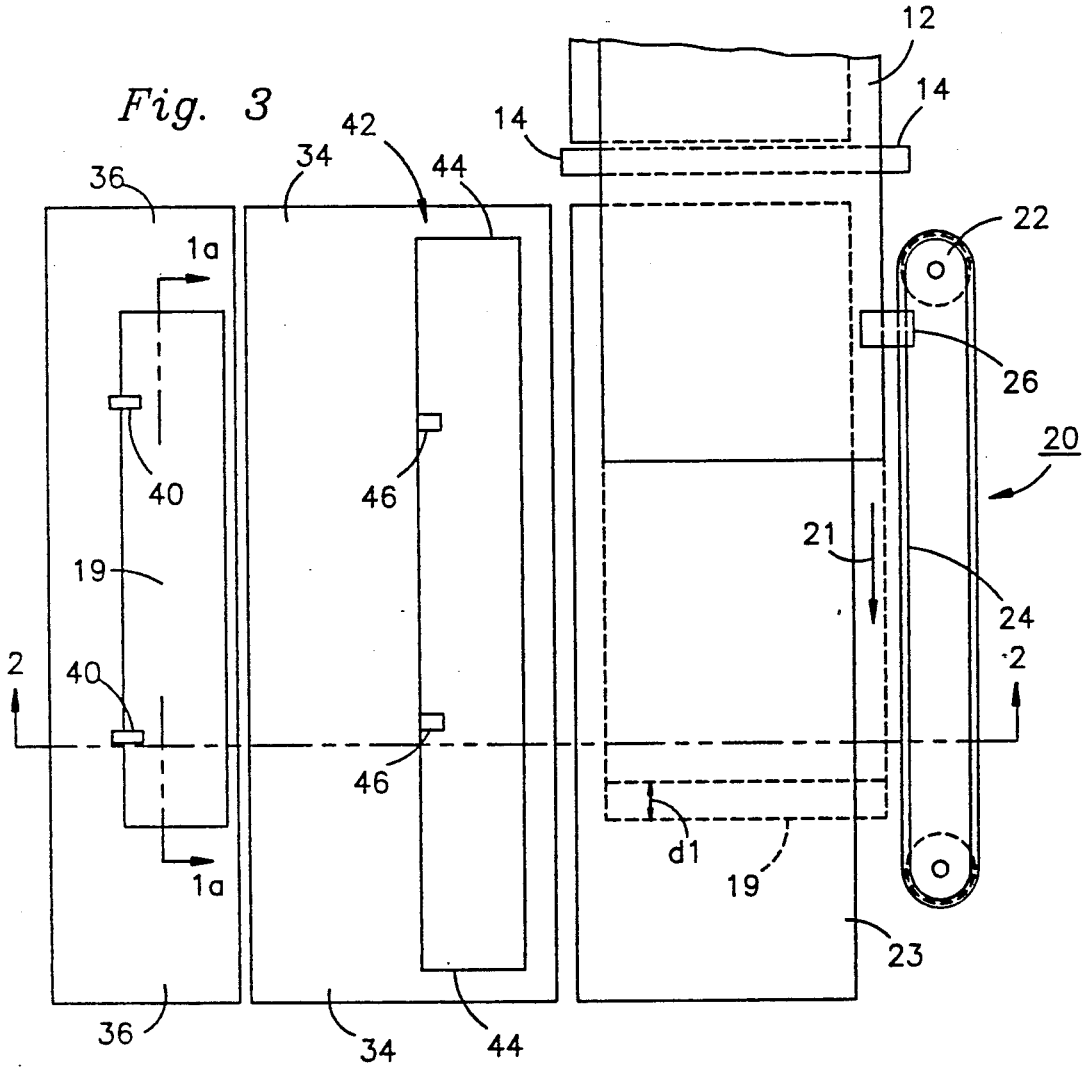
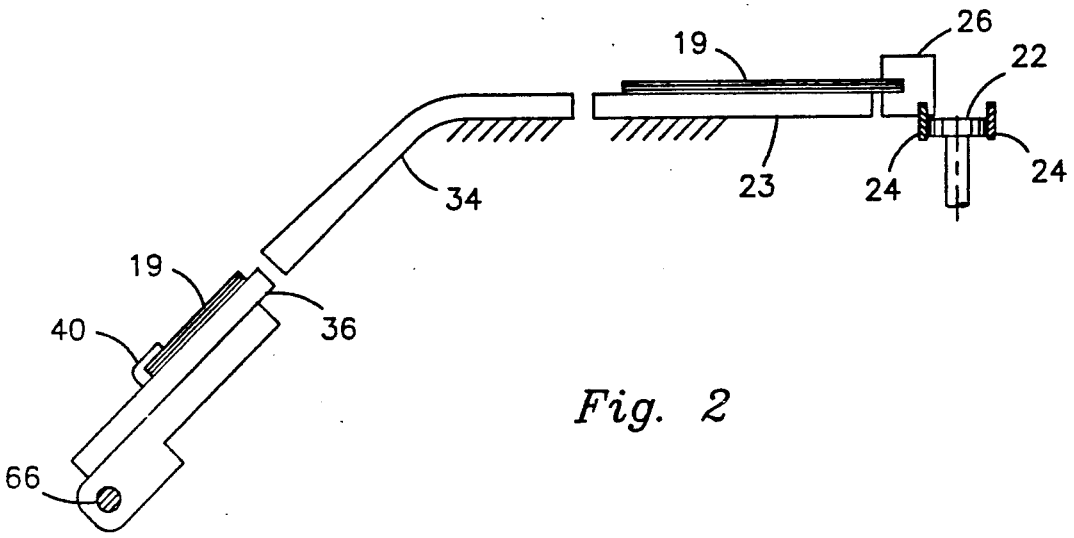
Fig. 2

METHOD FOR MAKING A TRANSFORMER CORE COMPRISING AMORPHOUS METAL STRIPS SURROUNDING THE CORE WINDOW

BACKGROUND

This invention relates to a method and apparatus for making an electric transformer core that comprises thin superposed strips of amorphous metal arranged in groups and surrounding the window of the core. The invention relates more particularly to a method and apparatus for making a core of this type that is characterized by lap joints between the opposite ends of each of these groups.

A widely-used type of lap joint construction that has good magnetic properties is one in which the lap joints are angularly offset, or staggered, repeating in a stair-step fashion as one proceeds from the window to the outer periphery of the core. This type of construction is referred to herein as a step-lap, or distributed-lap, joint construction. Example of this117 type construction are illustrated in our U.S. Pat. No. 4,734,975 and in U.S. Pat. No. 4,741,093—Lee and Ballard, both of which are incorporated by reference in the present application. A disadvantage of this type of joint construction is that its use produces an extra build-up in the cross-sectional area of the core in the joint region, and this build-up typically appears as a "bump" projecting radially outwardly on the outer surface of the core. This bump tends to produce significant problems in the manufacture of the core, as will soon be described. The bump can be eliminated if the core employs so-called "short sheets", utilizing a short sheet each time the step pattern of the lap joints is repeated. Each of these short sheets is a partial-length lamination having one of its ends butted with the overlapping end of the last lamination of one step-lap joint pattern and the other of its ends butted with the underlapping end of the first lamination of the next step-lap pattern. The presence of these short sheets builds up the cross-section of the rest of the core to equal the cross-section of the joint region, thus eliminating the above-described "bump". But for reasons well known in the art, as explained, for example, in the foresaid U.S. Pat. No. 4,741,096—Lee and Ballard, by the presence of short sheets results in localized regions of high flux density which can produce undesirable saturation effects. We, therefore, avoid the "short-sheet" approach in constructing our core and utilize a different approach for eliminating, or at least significantly reducing the size of, the above-described outwardly projecting bump during the portion of the core-making process when such bump can cause significant manufacturing problems.

Some of the problems associated with the above-described outwardly-projecting bump are as follows. If the core is to be assembled from superposed thin strips of amorphous metal, the presence of the bump makes it very difficult to effectively guide and locate the edges of the strips during a conventional core assembly operation, e.g., one in which the amorphous strips are wrapped about a rotating arbor with assistance from a moving belt partially surrounding the arbor. Another problem resulting from the presence of the bump in such a core assembly operation is that the increasingly eccentric mass of the core form as it is built-up around the arbor limits the speed at which the arbor can be rotated, thereby limiting the speed of the assembly operation. Still another problem is the tendency for laminations to change angular position as the arbor rotates. In this latter respect, it is difficult to keep the inside arbor and the outside wrapping belt moving at the same angular speed, especially as the belt contacts the bump.

Another problem that is encountered when one attempts to construct a core of amorphous metal strips encircling the core window is that because the amorphous metal strips are very thin (typically only about 1 mil in thickness, which is only about 1/10 to 1/20 the thickness of conventional silicon steel strips typically used), a very large number of strips must be wrapped or otherwise assembled about the core window in order to achieve the desired build of the core. Individually wrapping this large number of strips about the core window would be an excessively time-consuming and expensive process. To avoid the need for individually wrapping this large number of strips, it has been proposed, for cores with lap joints, that the strips be simultaneously wrapped about the core window in groups individually made up of the number of strips suitable for one lap joint, e.g., 10 to 20 strips. It would be desirable if the strips could be simultaneously wrapped in much larger numbers, thus forming a plurality of lap joints, and in the case of the step-lap joint core, a plurality of lap joints offset by precise predetermined amounts. Using conventional methods of core assembly, it is difficult to simultaneously wrap, or otherwise assemble, this many amorphous strips with their ends precisely located to provide the desired precisely located step-lap joints.

One way of ameliorating some of the above-described problems of precisely locating the strips is to wet the strips prior to core assembly with a suitable liquid. The liqid tends to hold adjacent strips together through surface tension during assembly, blocking undesired displacement of the strips. Unfortunately, the use of such liquids may involve environmental problems, or could cause rusting of the amorphous metal, particularly if the liquid is not fully evaporable during the core-making process. It is therefore desirable to eliminate the need for such liquids during the core assembly process.

OBJECTS

An object of our invention is to provide a method and apparatus for making an amorphous metal transformer core of the lap joint type in which the troublesome outwardly-projecting bump, described hereinabove, is eliminated or at least substantially reduced in size during the portion of the core-making process when such bump can cause significant manufacturing problems.

Another object is attain the immediately preceding object without the need for employing the above-described "short sheets".

Another object is to make an amorphous metal core by a method that utilizes strips of amorphous metal wrapped about an arbor and has an exceptional low tendency to displace the strips longitudinally out of the predetermined positions required for precisely locating the joints of the core.

Another object is to provide a method capable of fulfilling the immediately—preceding object without need to rely upon a liquid for wetting the strips prior to assembly.

Still another object is to make an amorphous metal core by a method and apparatus that enable the core to be assembled by simultaneously wrapping an exceptionally large number of amorphous metal strips about the core window.

Still another object is to make an amorphous metal core of the step-lap joint type by a method and apparatus that enable the core to be assembled by simultaneously wrapping a plurality of staggered groups of amorphous strips, i.e., a packet, about the core window.

Still another object is to build up a core form from amorphous metal strips, assembled in groups and packets, by a wrapping process that involves sequentially wrapping the packets one at a time about an arbor and, thus, readily lends itself to the making of lap joints between opposite ends of each group.

An additional object is to provide a method of bulding up a core form about an arbor that involves wrapping groups of amorphous metal strips about the arbor in such a manner that the length of the groups can be controlled as the wrapping operation proceeds in order to compensate for unpredictable variations that might develop in the tightness and overlap of groups wrapped at an earlier stage of the wrapping operation.

SUMMARY

In carrying out our invention in one form, we provide the following method for making a transformer core from strips of amorphous metal. We provide an arbor having a longitudinal axis and an external surface surrounding the axis and extending along the length of the arbor. The arbor has a transverse cross-section normal to said axis of a solid having an external perimeter including a surface portion having a concave configuration forming a depression in the perimeter. We also provide a plurality of packets, each comprising a plurality of groups of amorphous metal strips, each group comprising a plurality of elongated strips having substantially aligned longitudinally-extending edges and substantially aligned transversely-extending edges at opposite ends of the group. The groups themselves within each packet have (i) longitudinally-extending edges that are substantially aligned and (ii) transversely-extending edges at the ends of the packet that are staggered with respect to each other longitudinally of the packet. We wrap these packets in superposed relationship about the arbor while holding the arbor against rotation, thus building up a core form about the arbor. Each packet is located prior to its being wrapped about the arbor so that when the packet is wrapped, opposite ends of each group within the packet meet in overlapping relationship in a location angularly aligned with said surface portion of concave configuration.

In accordance with another feature of the invention, we employ an arbor that has a perimeter that is of a convex configuration at substantially all locations except where it is concave to form the above-noted depression. This convex configuration helps to provide radial force on the wrapped packets at substantially all regions of the perimeter outside the concave surface portion, thus helping to hold the packets tight on the arbor when they are wrapped about the arbor.

In accordance with still another feature, we effect wrapping of each packet by first wrapping one end of the packet about one side of the arbor and then clamping this one end to the concave surface portion of the arbor. Then we wrap the other end of this packet about the other side of the arbor, following which we clamp this other end to the concave surface portion of the arbor.

In accordance with still anothe feature, just before each packet is wrapped, we clamp an intermediate portion of the packet to the surface portion of the arbor on the opposite side of the arbor from said concave suface portion, thus effectively inhibiting longitudinal motion of the strips and groups of the packet with respect to each other during the wrapping operation.

In accordance with another aspect of our invention, we provide apparatus for carrying out the core-making method summarized hereinabove. One feature of such apparatus is the presence of wraping mechanism that includes a flexible belt that is positioned before wrapping at the back side of the arbor opposite to the location of the concave surface portion. Before wrapping, each pocket is positioned between this belt and the arbor. One zone of the belt is first wrapped about a first portion of the arbor to wrap one portion of the packet about said first portion of the arbor and to locate one end of the packet in angular alignment with said concave surface portion, and another zone of the belt is then wrapped about a second portion of the arbor to wrap the remaining portion of the packet about the second portion of the arbor and to locate the other end of the packet in angular alignment with the concave surface portion and in overlapping relationship with the first end of the packet.

BRIEF DESCRIPTION OF FIGURES

For a better understanding of the invention, reference may be had to the following detailed description of one embodiment of the invention taken in conjunction with the accompanying drawings, wherein:

FIG. 1*a* is taken in the direction of line 1*a*—1*a* of FIG. 3 when the packet has been assembled on the carrier depicted therein.

FIG. 2 is a diagrammatic view taken in direction of the line 2—2 of FIG. 3 showing, adjacent the bed of FIG. 1, an incline plane down which each group of strips is moved and a carrier at the bottom of the incline plane for receiving each group after it has been moved down the incline plane.

FIG. 3 is a schematic plan view of the apparatus depicted in FIG. 2. The composite strip is shown in solid lines, and a group of strips cut therefrom is shown in dotted lines on the bed of the shearing means. A traversing mechanism is schematically shown on the incline plane, and a previously sheared strip is shown resting on the carrier.

DETAILED DESCRIPTION OF EMBODIMENT SHEARING THE COMPOSITE STRIP 12 TO FORM GROUPS 19

Figure 1:
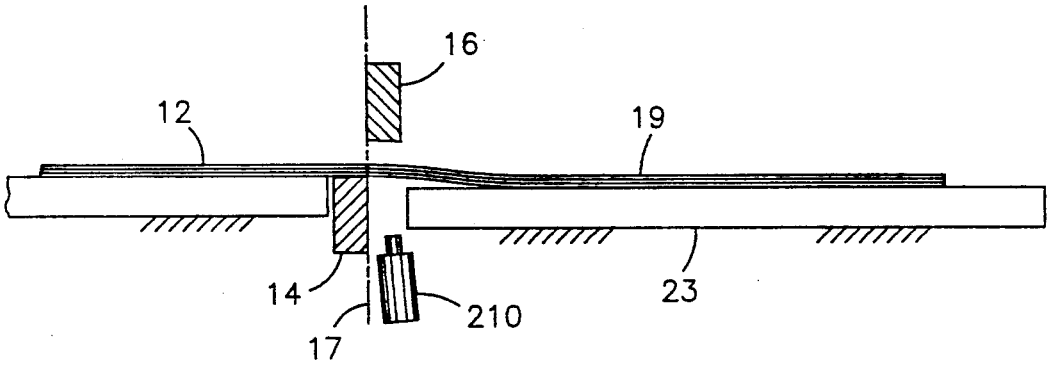
FIG. 1 is a schematic side-elevational view of a portion on our apparatus, specifically shearing means for cutting groups of amorphous steel strips from a continuous composite strip. The continuous strip is shown with its forward end positioned above a stationary bed just prior to a shearing operation.
Figure 10:
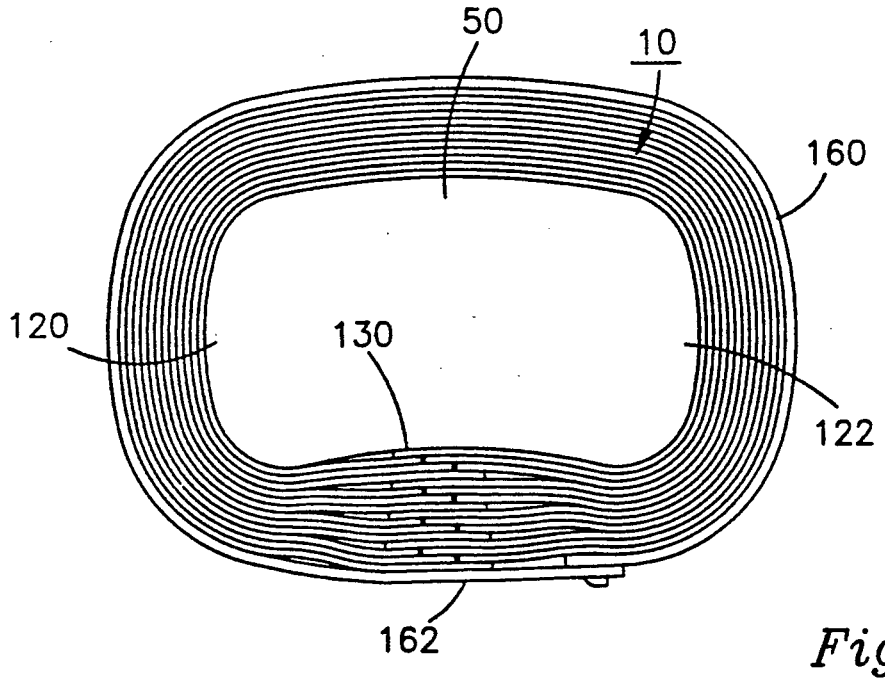
FIG. 10 is a plan view showing a core form after having been buit-up to its full thickness by repeatedly wrapping packets about the arbor. An outer protective wrapper is shown at the outer periphery of the core form.

Referring now to FIG. 1, there is shown a continuous composite strip 12 of amorphous steel from which it is desired to construct the transformer core, an intermediate form of which is shown at 10 in FIG. 10. The composite strip 12 is made up of many individual strips of amorphous steel, e.g., 10 to 20, stacked in superposed relationship. The individual strips are essentially identical, each having a thickness of about 1 mil. Within the composite strip, the lateral edges of the individual strips are substantially aligned.

The composite strip is cut into segments of predetermined length by shear blades 14 and 16 initially disposed on vertically-opposed sides of the composite strip. These shear blades are preferably of the design disclosed and claimed in copending patent application Ser. No. 334,248—Taub et al, filed Apr. 6, 1989, which has issued as U.S. Pat. No. 4,942,798. When the composite strip has been advanced to the right sufficiently to locate the desired length of strip to the right of the cutting plane 17 of the blades, the upper blade is driven vertically downward to shear the composite strip along the cutting plane 17. The resulting segment that appears to the right of the cutting plane is referred to herein as a group of strips 19. In each group, the transversely-extending edges of the strips at the end of the group will be aligned, and the longitudinally-extending lateral edges of the strips will usually be substantially aligned.

ASSEMBLING GROUPS 19 INTO PACKETS 52 FOR SUBSEQUENT WRAPPING ABOUT ARBOR 50

Figure 1A:
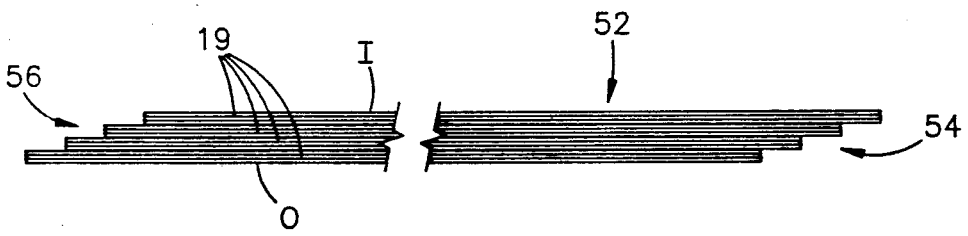
FIG. 1*a* is a cross-sectional view of a packet formed from a plurality of groups of strips stacked in supersposed, staggered relationship.

As will soon be described in greater detail, the transformer core form (shown at 10 in FIG. 10) is made by wrapping groups 19 of strips (cut from the continuous strip 12 in the above-described manner) about a static arbor 50, best shown in FIGS. 5-10. This arbor, which will soon be described in more detail, has a central longitudinal axis 47, an external surface 49 surrounding the axis and extending along the length of the arbor, and a transverse cross-section normal to the axis of a solid having an external perimeter including a concave surface portion 130 forming a depression 131 in the perimeter. The groups of strips are cut to lengths that are sufficient to enable each group to completely surround the arbor and to overlap at its ends by a predetermined amount, which amount is kept substantially constant for each group throughout the core build as will soon appear more clearly. A typical overlap is about ½ inch. In addition, as will soon be described in greater detail, the groups are assembled into packets prior to being wrapped about the arbor 50. A typical packet, prior to its being wrapped, is shown at 52 in FIG. 1*a*. Referring to FIG. 1*a*, each of these packets 52 comprises a plurality of groups 19, the groups in each packet being disposed in longitudinally staggered relationship so that at one end 54 of the packet the ends of succeeding groups overlap and at the other end 56 of the packet the ends of succeeding groups underlap. When a packet is wrapped around the arbor 50, each group 19 has its leading edge (at end 54) positioned immediately adjacent the trailing edge (at end 56) of the group that immediately precedes it.

For advancing the composite strip as described in the second paragraph of this Detailed Description, a suitable indexing mechanism 20 (schematically shown in FIGS. 2 and 3) is provided. This indexing mechanism grasps the composite strip and pulls this strip forward along a horizontal bed 23 in the direction of arrow 21 into the precise position needed to provide the required group length, holding the strip stationary while it is being sheared as above described. The indexing mechanism, in one form, comprises a chain and sprocket drive 22 that advances its chain 24 along the desired path of movement 21 of the composite strip. Grasping means 26 mounted on the chain releasably couples the composite strip to the chain during the advancing operation. The grasping means 26 is of a suitable conventional design and is therefore shown in schematic form only. For initially advancing the composite strip 12 into a position where it can be grasped by grasping means 26, suitable upstream actuating means 210 (best shown in FIG. 17) is provided. This upstream actuating means releases the strip 12 at an appropriate instant after the indexing means 20 has assumed control of the strip.

After the composite strip has been advanced and sheared as above described, the resulting group of strips 19, still held by the grasping means 26, is moved as a unit by the indexing mechanism an additional distance d1 in the direction of arrow 21, following which the group 19 is released by the grasping means 26. Immediately after such release, the chain 24 is driven by its sprockets in an opposite direction to arrow 21, thus resetting the indexing means 20 to its position of FIG. 1 in preparation for handling in the same manner as above described composite strip 12 and the the next group of strips that is sheared from the composite strip 12.

The amount d1 of forward movement that the indexing mechanism 20 advances the first group 19 along the bed 23 after this first group 19 is cut from the composite strip 12 determines the location on the perimeter of arbor 50 where the lap joint formed between the ends of this first group will be located. In the wrapped core form, this lap joint in the first group 19 is the last, or outermost, lap joint in the first, or inside, packet 52. The amount of this forward movement is selected so that this lap joint will be located in angular alignment with the depression 131 in concave surface portion 130 of the arbor 50 and, more specifically, will be located to the right of a central bisecting plane 51 that passes through the nadir of the depression 131 on the arbor, as seen for example in FIGS. 5 and 16.

Next, the group of strips 19 that has been formed and indexed forward as above described is moved as a unit transversely of the strip length down an incline 34 and onto a carrier 36, where it is clamped in place by suitable clamps 40 located on the carrier. This transverse movement of the group is effected by a suitable traversing mechanism 42 (FIG. 3), which effects such transverse movement of the group without changing the longitudinal position of the group, i.e., its position considered in the direction of arrow 21. Since the details of this traversing mechanism 42 are not a part of this invention, this mechanism is shown schematically only. It is sufficient to note that the traversing mechanism as depicted in FIG. 3, comprises (1) a frame 44 that is reciprocally movable along the incline 34 in a direction perpendicular to arrow 21 and (2) releasable clamps 46 attached to the frame 44. In FIG. 3 the frame 44 is shown passing through an intermediate position along the incline 34. Referring to FIG. 3, when the indexing means 20 releases the group of strips 19, as above described, the traversing mechanism frame 44 is moved into a position where the clamps 46 thereon can grip the left-hand edge of the group 19. The clamps 46 are then automatically operated to grip the edge of the group, thereby coupling the group to the frame 44 while the frame is moved to the left in FIG. 3, carrying the group onto the carrier 36. When the group is properly positioned on the carrier, the clamps 40 on the carrier are automatically operated to grip the left hand edge of the group, and the clamps 46 on the traversing frame are released. When this has occurred, the traversing frame 44 is reset to a position over the bed 23, where its clamps 46 can grip a newly-sheared group of strips 19 and repeat the transverse shifting operation. While the first group of strips is being transferred to the carriage 36, the leading edge of the composite strip is being advanced again into a new position where a second group of slightly shorter length than the first group is sheared off the composite strip. The length of this second group (and each subsequent new group in the first packet) is selected to be less than that of the immediately-preceding group by an amount $2\pi t$, where t is a representative thickness of the individual groups. After such shearing, this second group is advanced to the right in FIG. 1 by a distance d2 slightly greater than the distance d1 that the first group was moved plus the amount of overlap selected for each lap joint. Then the second group is moved transversely of the strip length, down the incline 34, and onto the carrier 36. The second group is positioned atop the first group with its right hand edge offset from the right hand edge of the first group by a distance slightly greater than the amount of overlap selected for each lap joint.

A packet 52 will typically comprise 4 to 14 superposed groups. In the same manner as described above, each succeeding group is cut from the composite strip 12 and placed atop its immediately preceding group in the appropriate staggered position until a full packet is assembled. Such assembly occurs atop the carrier 36, where the full packet is held in place by the clamps 40 until the carrier 36 has transported the packet into its position of FIG. 4. adjacent the arbor 50, as will soon be described.

An important point to note with respect to each packet 52 assembled on the carrier 36 is that the first group of the packet deposited on the carrier is the outermost group of the packet (as indicated by the letter O in FIG. 1*a*), and the last group of the packet deposited on the carrier 36 is the innermost group of the packet (as indicated by the letter I in FIG. 1*a*). The groups within the packet are made progressively shorter from the first-deposited to the last-deposited group of the packet, each group being made progressively shorter than the group deposited immediately ahead of it by an amount $2\pi t$, where t is a representative thickness of the individual groups. Successive groups are offset by an amount slightly greater than the selected amount of overlap in each joint, which in this embodiment is ½ inch.

In the next packet 52 that is assembled on the carrier, the first-deposited group 19 has a length equal to the length of the first-deposited group of the immediately-preceding packet plus n $2\pi t$, where n is the number of groups in this next packet and t is the same quantity as above. Each successively-deposited group of this packet is made shorter than its immediate predecessor by an amount $2\pi t$ and is also offset in the same direction as in the first group by an amount slightly greater than the selected overlap in each joint. The first-deposited group 19 of this next packet 52 is deposited on the carrier 36 slightly beyond (in the direction of arrow 21 of FIG. 1) the first-deposited group of the immediately-preceding packet so that in the wrapped core form depicted in FIG. 16 these first-deposited joints appear along a generally radial line 47 that marks one border of the joint region. Another generally radial line 53 marks the other boundary of the joint region.

TRANSPORTING A PACKET 52 TO A LOCATION FOR WRAPPING

Figure 4:
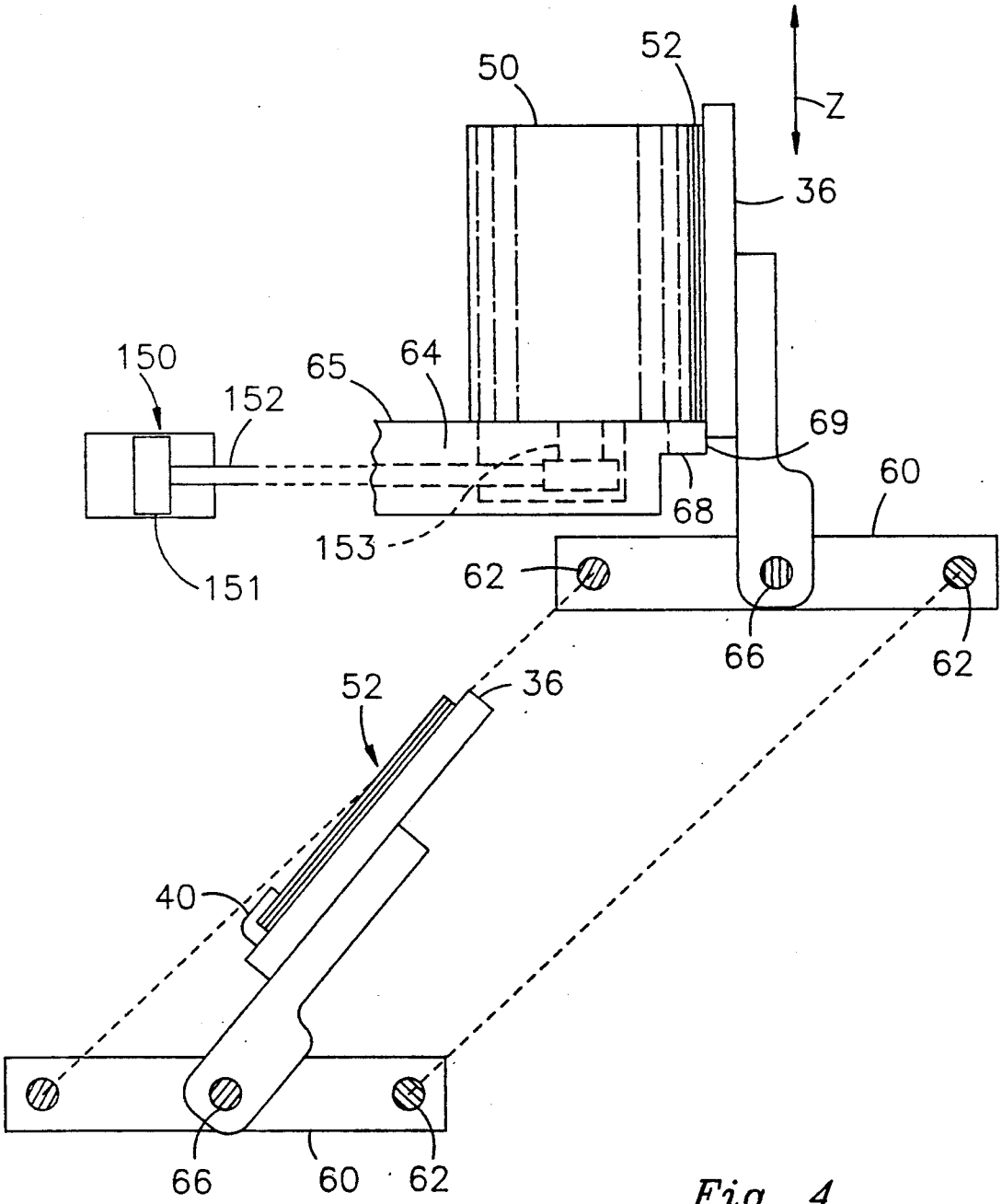
FIG. 4 is a schematic showing of the carrier, as viewed from one edge, with a packet positioned thereon. The carrier is depicted in two different positions. In the right hand one of these positions, the carrier has located the packet thereon adjacent an arbor about which the packet is to be wrapped.

Referring to FIG. 4, the carrier 36 is shown pivotally supported on a base 60 that is mounted for linear motion along spaced-apart guide rods 62 extending through holes in the base. When a full packet 52 has been assembled upon the carrier 36, the base 60 is moved horizontally along the guide rods 62 into a position where the packet 52 is aligned with the arbor 50. The arbor 50 rests upon a table 64 having a planar horizontal upper surface 65 and an edge 69. When the packet is positioned in alignment with arbor 50, the carrier 36 is pivoted in a counter-clockwise direction about pivot 66 until the packet 52 thereon engages the arbor 50. The table 64 has a ledge 68 including notches in edge 69 for receiving the clamps 40 so that the packet may be pivoted into contact with the arbor if no packet is yet present on the arbor, or into contact with the last packet wrapped about the arbor if one or more packets has already been wrapped.

Figure 16:
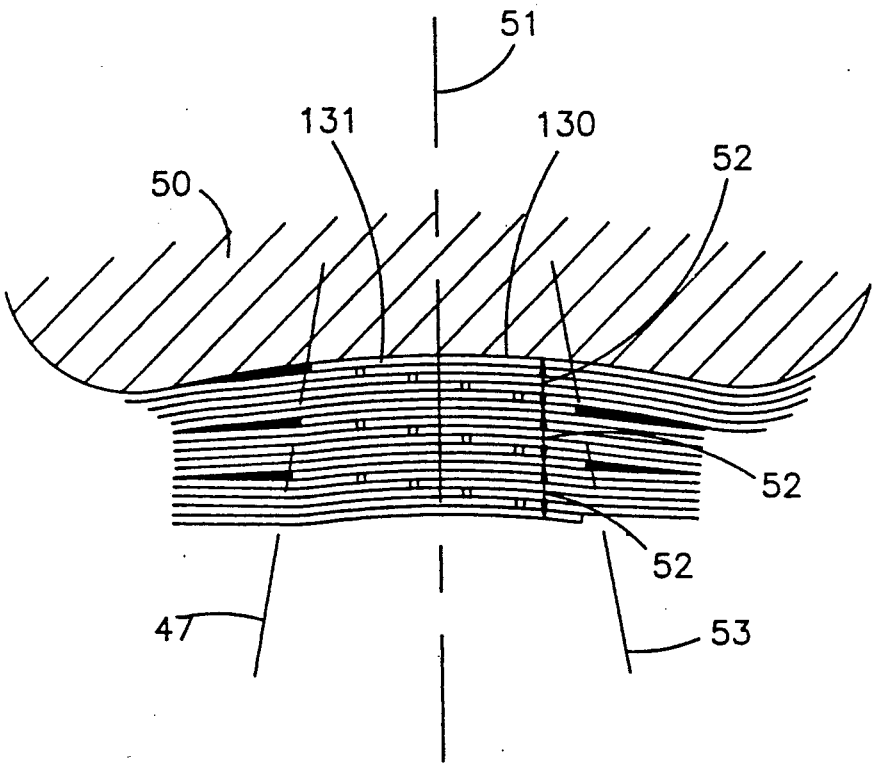
FIG. 16 is an enlarged view of the joint region of our core form after some but not all the packets have been wrapped about the arbor.

As will soon appear more clearly, the core form of FIGS. 10 and 16 is built up by sequentially wrapping packets, assembled as above described, about the arbor 50. The packets are wrapped about the arbor individually, with each packet being wrapped around the previously-wrapped packets of the core form.

THE WRAPPING MECHANISM SUBASSEMBLY 70 AND ITS OPERATION DURING THE EARLY STAGES OF WRAPPING ONE OF THE PACKETS 52

Figure 5:
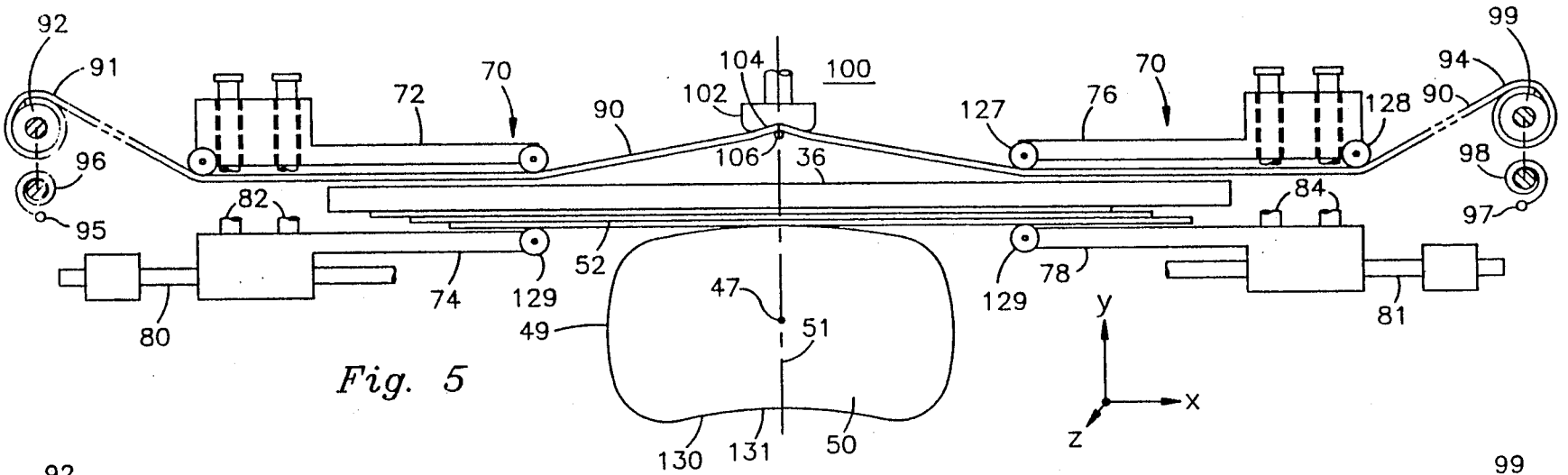
FIG. 5 is a plan view of a wrapping mechanism subassembly showing a packet positioned adjacent the arbor of the subassembly in preparation for wrapping.
Figure 6:
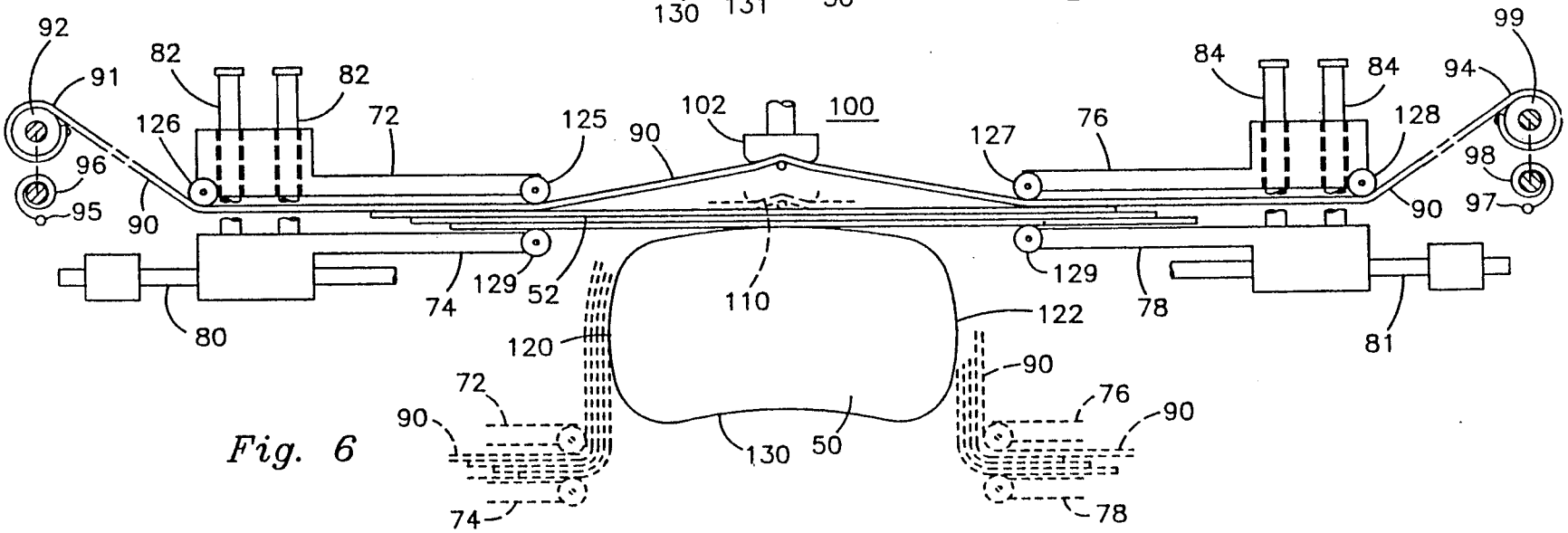
FIG. 6 is another plan view of the wrapping mechanism subassembly of FIG. 5 depicting the subassembly at several early stages of a wrapping operation.

When the first packet 52 has been placed in its position of FIG. 4, a wrapping mechanism subassembly 70, best shown in FIGS. 5 and 6, is moved into position to proceed with wrapping of the packet about the arbor 50. This wrapping mechanism subassembly 70 comprises four wrapping arms 72, 74, 76 and 78 each of which is suitably mounted for movement in two horizontal directions x and y (FIG. 5) and also for movement in a vertical direction z depicted in FIGS. 4 and 5.

The full mounting means for these arms is not shown, but there are shown horizontal guide rods 80 along which one pair of wrapping arms 72 and 74 is movable in an x direction and additional horizontal guide rods 81 along which the other pair of wrapping arms 76 and 78 is movable in an x direction. In addition, there are shown guide rods 82 fixed to front arm 74 along which one of the back wrapping arm 72 is horizontally movable in a y direction with respect to its associated front wrapping arm 74. Similar guide rods 84 fixed to front arm 78 are shown along which the other of the back wrapping arms 76 is movable with respect to its associated front arm 78. The guide rods 80 and 81 can be moved horizontally in the y direction and can also be moved vertically in the z direction. The mechanisms and actuators for effecting all of these movements of the wrapping arms are conventional and therefore have not been shown in detail in the drawings.

Referring to FIG. 5, the wrapping mechanism subassembly 70 further comprises a flexible wrapping belt 90 that has two ends 92 and 94. End 92 is coupled to a terminal pin 95 through a take-up reel 91 and biasing means 96 that exerts through the take-up reel 91 a biasing force on the belt along its length tending to keep it taut. This biasing means has been schematically shown as comprising a helical spring, but in a preferred form of the invention, it comprises a fluid motor (not shown) exerting a force on the belt in substantially the same direction as would the illustrated helical spring. The other end 94 of the belt 90 is coupled to a terminal pin 97 through a corresponding take-up reel 99 and biasing means 98 acting in opposition to the biasing means 96 and also tending to keep the belt taut.

The wrapping belt 90 extends from its end 92 to its end 94 via a location between the two wrapping arms 72 and 74 and then through a location between the other two wrapping arms 76 and 78. Midway of the belt length is a stabilizing device 100 that comprises a block 102 having a front face 104 against which the belt is captured by a vertically-extending pin 106 carried by the block 102 on the opposite side of the belt. The pin 106 and the block face form a generally U-shaped passage for receiving the belt 90. Once the block 102 is located at the proper level (in a z direction), it can be actuated in the y direction to drive the front face of the block into a position in which the belt 90 engages the back surface of the packet that is then being wrapped about the arbor 50. Just prior to the carrier's 36 being moved into its position of FIG. 4, the portions of the wrapping mechanism subassembly 70 depicted in FIG. 5 are located above the arbor to allow the carrier 36 to be pivoted counterclockwise into its FIG. 4 position without interference from the wrapping mechanism subassembly.

When the carrier 36 has been so pivoted, the packet thereon is released from the carrier, positioning the packet so that it is resting on its lower edge in contact with the back surface of the arbor (or with the last packet wrapped about the arbor in the case of subsequent packets). Then the carrier is pivoted clockwise about pivot 66 from its position of FIG. 4 to a non-interfering position with respect to the wrapping mechanism subassembly 70, immediately after which the wrapping mechanism subassembly 70 is lowered until the belt 90 is positioned at mid-height on the arbor. At this point the left-hand wrapping arms 70 and 74 are located on opposite sides of the packet at the left-hand end of the packet, and the right-hand wrapping arms 76 and 78 are located on opposite sides of the packet at the right-hand end of the packet in the same widely-spaced relative positions as depicted in FIG. 5. Next, the two back arms 72 and 76 are moved together toward their respective front arms 74 and 78 into their solid-line positions depicted in FIG. 6. In FIG. 6, the back wrapping arms 72 and 76 are in proximity to the front wrapping arms, but the packet is still not yet snugly held by the wrapping arms or the belt 90.

As will soon appear more clearly, during a wrapping operation the belt 90 and the associated end of the packet 52 move longitudinally within the space between the back and front wrapping arms. To facilitate such movement, the left-hand back arm 72 is provided with rollers 125 and 126 at its left-hand and right-hand ends. The other back arm 76 is provided with corresponding rollers 127 and 128 serving a corresponding function. Each of these rollers is mounted on its associated back arm by suitable means allowing free rotation of the roller about a vertical axis fixed relative to the associated arm. When a back arm 72 or 76 is moved in an x or y direction, as during a wrapping operation, the belt 90 moves with respect the associated arm in a direction longitudinally of the belt, causing rolling of the rollers and thus reducing friction between the belt and the back arm 72. Similar rollers 129 are provided on each of the front arm 74 and 78 to allow the packet to be moved along the front arm with less friction in a longitudinal direction with respect to the front arm. To further facilitate the above-described motion of the belt 90 and the packet end with respect the wrapping arms 72 and 74, enough spacing is provided between these two arms during the wrapping operation to prevent binding of the belt or packet on the wrapping arms in this space.

CLAMPING A PACKET TO THE BACK OF THE ARBOR 50 AT AN EARLY STAGE OF THE WRAPPING OPERATION

As the next step in the wrapping operation, the block 102 of the stabilizing device 100 is driven forward into its dotted line position of FIG. 6, thereby forcing the belt 90 against the back surface of the packet and also clamping the packet against the back surface of the arbor 50 at a location 110. A suitable pneumatic actuator (not shown) is used for driving the block 102 forward in this manner, operation of the actuator being initiated automatically in response to arrival of the back arms 72 and 76 in their solid-line positions of FIG. 6. The pneumatic actuator holds the block 102 in its dotted line position until the wrapping of the packet is completed, exerting a moderate clamping force against the belt 90 and the arbor 50 during this entire interval.

The clamping force exerted through the block 102 serves a number of important functions. First, it prevents the belt 90 from sliding along its length tangentially of the arbor should, for any reason, unequal forces be exerted on the belt at locations on opposite sides of the clamping location 110. Such tangential motion of the belt 90 is undesirable because it would tend to cause the amorphous metal groups 19, or even the strips forming the groups, to slide on each other along their length, thus interfering with the desired precision in locating the ends of the strips during wrapping. Another important function served by the clamping action at location 110 is that it helps to prevent the belt from twisting and also from being undesirably displaced in a vertical direction.

PROCEEDING WITH THE WRAPPING OPERATION

After the above-described clamping at 110, the wrapping arms 72 and 74 and 76 and 78 are moved forward in unison (primarily in a y direction) to their dotted line positions depicted in FIG. 6. This has the effect of wrapping the belt 90 partially around the ends 120 and 122 of the arbor 50, which, in turn, wraps the packet 52 partially around these ends 120 and 122 since the packet is located between the belt and the arbor. This forward motion of the wrapping arms causes some longitudinal motion of each end of the packet 52 within the space between the adjacent front and back wrapping arms, e.g., 72 and 74, but this longitudinal motion can occur freely in view of the presence of anti-friction rollers 125, 126, 127, 128, and 129 and the fact, previously noted, that the spacing between the front and back arms is sufficient to prevent the wrapping arms from tightly gripping the intervening belt and packet portions.

Figure 7:
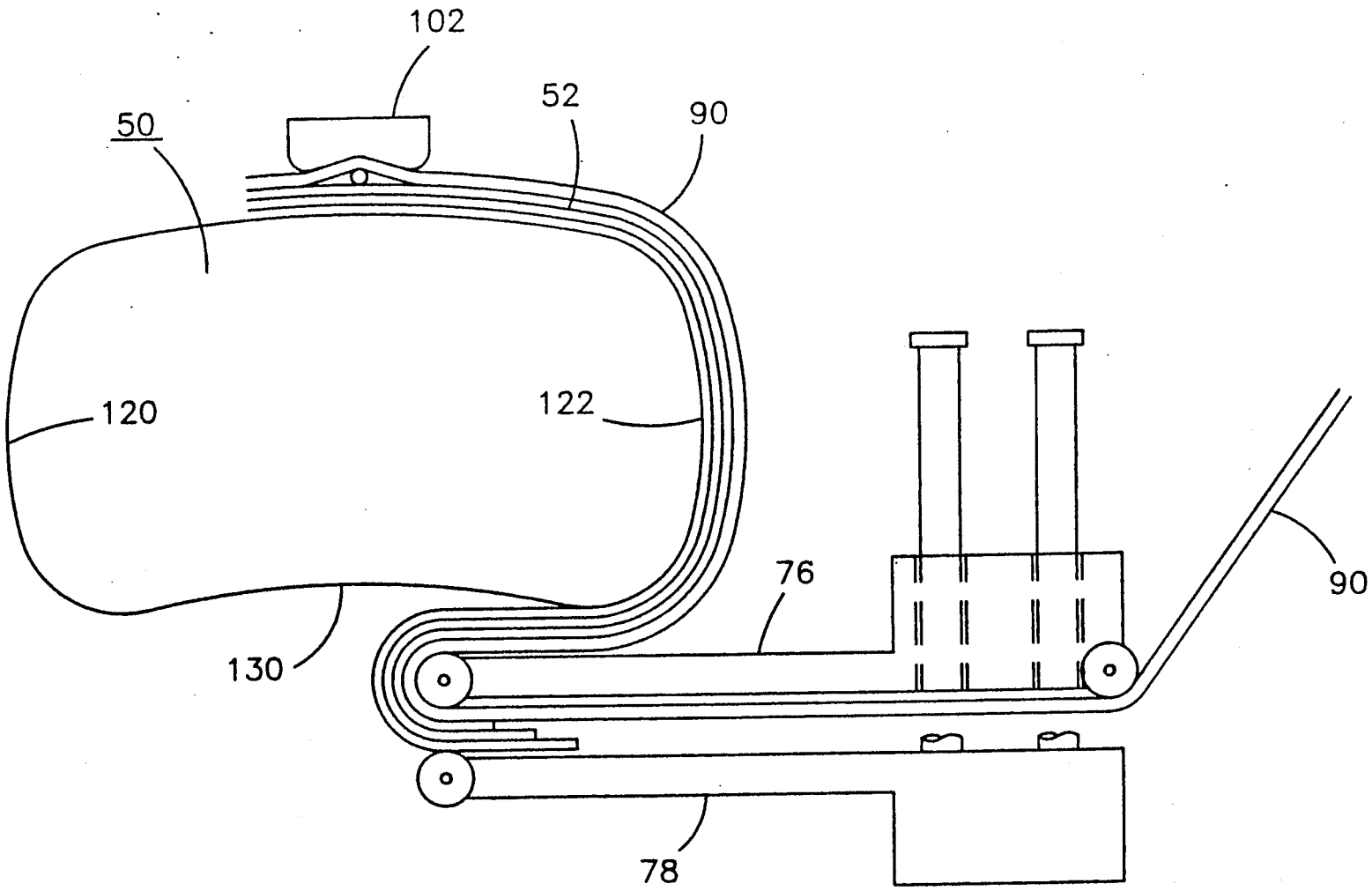
FIG. 7 is an enlarged view of a portion of the wrapping mechanism of FIG. 6 showing a portion of the wrapping mechanism at a more advanced stage of the wrapping operation.

After the wrapping arms have reached their dotted line positions of FIG. 6, the right-hand wrapping arms 76 and 78 are moved to the left (in an x direction) through their position of FIG. 7. This motion results in the belt 90 being wrapped snugly around the entire right-hand end 122 of the arbor 50, thereby also wrapping snugly the right-hand half of the packet 52 around the entire right-hand end of the arbor. Further motion of the right-hand wrapping arms 76 and 78 to the left causes the end of the right-hand half of the packet 52 to move longitudinally completely out of the space between the wrapping arms 76 and 78, following which this end of the packet comes to rest against the concave forward face 130 of the arbor 50, as shown in FIG. 8.

Figure 8:
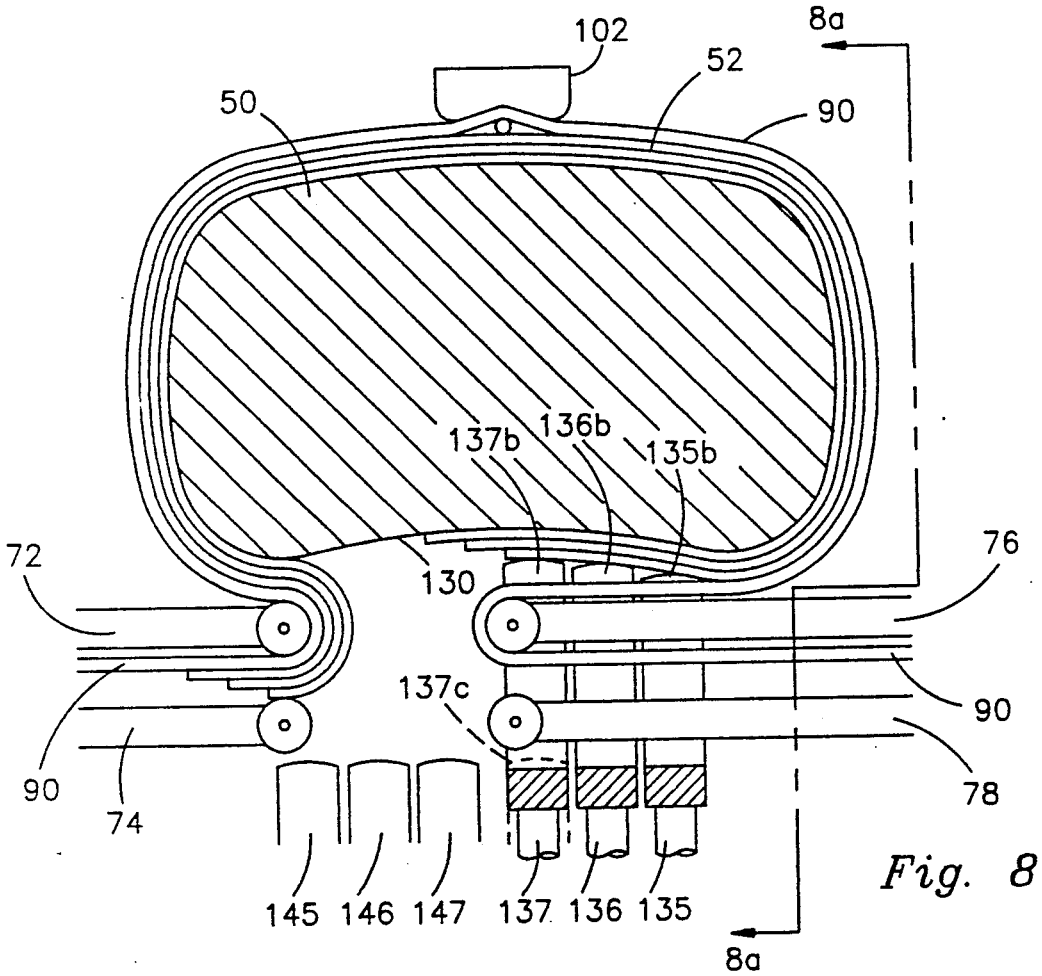
FIG. 8 is a view similar to FIG. 7 except illustrating a still more advanced stage of the wrapping operation and, more specifically, a stage wherein the right hand end of a packet has been laid down against the arbor and the left hand end of this packet is about to be laid down over the right hand end.
Figure 8A:
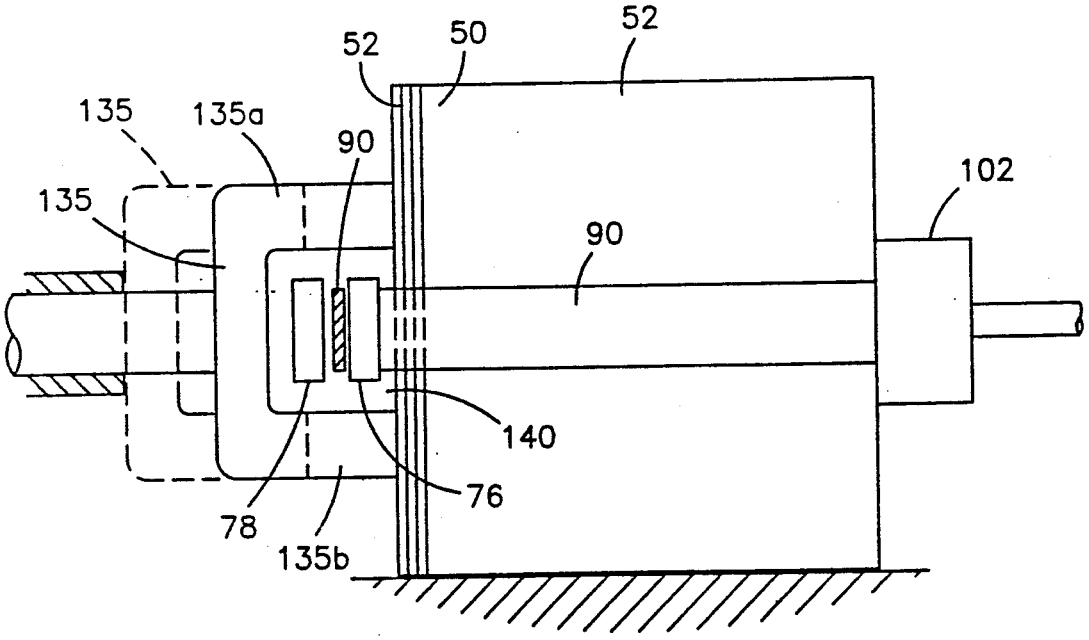
FIG. 8*a* is a sectional view taken along the lines 8*a*—8*a* of FIG. 8 and showing more details of the clamping fingers forming a part of the wrapping mechanism.

After entering the position of FIG. 8, the end of the right-hand half of the packet 52 is clamped to the concave face 130 of the arbor by a plurality of fingers 135, 136 and 137. As shown in FIGS. 8 and 8*a*, each of these fingers 135, 136 and 137 is bifurcated into upper and lower sub-fingers (e.g., 135*a* and 135*b*) between which is located a space 140 for freely receiving the inner ends of the wrapping arms 76 and 78. When the wrapping arms 76 and 78 are passing from their positions of FIG. 6 into and through their positions of FIG. 7, the fingers 135, 136 and 137 are retracted, i.e., withdrawn from the arbor 50 into position typified by the dotted line position of the finger 135 of FIG. 8*a*. This retraction enables the packet end to be carried past the fingers without interference from the fingers. But when the packet end has been carried past the position of a finger, the finger is driven back into its solid-line position shown in FIGS. 8 and 8*a* to clamp the packet end to the arbor. For controlling the fingers 135–137 in this manner, conventional pneumatic actuators (not shown), one for each finger, are provided. Suitable controls for these actuators cause them to retract and restore the fingers in response to movement of the wrapping arms through predetermined positions as the arms move from their position of FIG. 6 into those of FIG. 8.

The space 140 provided in each finger between its upper and lower subfingers enables the finger to be restored to its clamping position without interference from the wrapping arms, even though they might still be in a position between the finger and the arbor, e.g., as in FIGS. 7 and 8.

Figure 9:
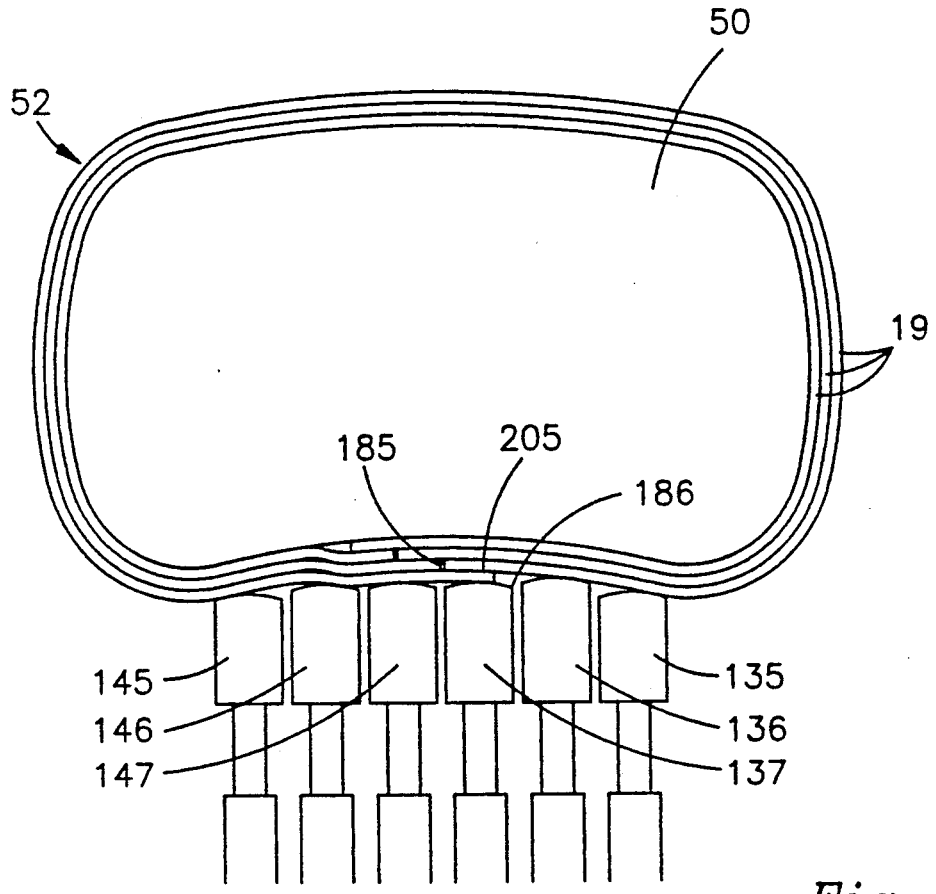
FIG. 9 is a plan view of a portion of the wrapping means after a first set of lap joints has been formed at the ends of a packet and while this packet is being held in wrapped condition by the clamping fingers of FIGS. 8 and 8*a*.

After the right-hand half of the packet 52 has been fully wrapped about the right-hand side 122 of the arbor 50 and its end laid down and clamped against the concave face 130 of the arbor, as above described, wrapping of the left-hand half of the packet 52 is resumed and carried to completion. This resumed wrapping of the left-hand half is effected by moving the left-hand wrapping arms 72 and 74 from their dotted-line positions of FIG. 6 to the right into and through their positions depicted in FIG. 8. This causes the end of the left-hand half of the packet 52 to be laid down in essentially the same manner as described above for the end of the right-hand half except that the end of the left-hand half is laid down over the end of the right hand half. More specifically, the left-hand end of each group 19 in the packet, upon being laid down, overlaps its own right-hand end, thus forming a lap joint between these two ends of each group, as is depicted in FIG. 9.

Fingers 145, 146 and 147, corresponding to the above described fingers 135, 136 and 137 are provided to clamp the end of the left-hand half of the packet 52 to the arbor 50, and these fingers 145, 146 and 147 act in essentially the same manner as the fingers 135, 136, 137 to effect such clamping. Each of the fingers 145, 146 and 147 also has a pneumatic actuator (not shown) that acts to withdraw the finger to allow the packet to pass the location of the finger, following which the actuator drives the finger back toward the arbor. When these fingers are driven back toward the arbor, they act to clamp the then laid-down end of the left-hand half of the packet to the arbor in the position depicted in FIG. 9.

It is to be noted that when the right-hand end of a packet is being laid down, one or more of the left-hand fingers 145–147 also needs to be withdrawn to allow passage of the right-hand end of the packet past the finger location as the right-hand end is being laid down.

Similarly, where the left-hand end of a packet if being laid down, one or more of the right-hand fingers 135-137 needs to be withdrawn in order to allow passage of the left-hand end of the packet past the finger location as this left-hand end is being laid down. The actuator for each of the fingers is controlled in such a manner as to produce such withdrawal of the required finger and so as also to produce return of such finger to its clamping position immediately after the packet end has been laid down. In FIG. 8, a dotted line position 137*c* for one of the right-hand fingers 137 is shown, and it is into this position 137*c* that the finger 137 is moved to allow the left-hand end of the packet 52 to be deposited atop the already laid-down right-hand end. Thereafter, finger 137 is returned toward its clamping posture depicted in FIG. 8, where it then clamps both ends of the packet to the concave surface portion of the arbor, as shown in FIG. 9.

RESETTING THE WRAPPING MECHANISM SUBASSEMBLY 70 AFTER WRAPPING OF THE FIRST PACKET

After the first packet 52 has been wrapped about the arbor 50 and clamped in its fully wrapped condition to the front face of the arbor, as above described, the wrapping arms together with belt 90 are withdrawn from their positions at the front of the arbor and returned to their positions of FIG. 5. This return movement carries the wrapping arms and the belt 90, in succession, through their dotted line positions of FIG. 6, their solid line positions of FIG. 6, and then into their positions of FIG. 5, thus fully resetting them in preparation for the wrapping of the next packet about the arbor.

Concurrently with resetting of the wrapping arms and the belt, the clamping block 102 on the rear face of the arbor is withdrawn from its dotted line position of FIG. 6 into its solid line position and then into its initial position of FIG. 5.

WRAPPING THE NEXT PACKET AND SUCCEEDING PACKETS

The next packet is wrapped about the arbor in essentially the same manner as the first packet, except that this next packet is wrapped about the outer periphery of the already-wrapped first packet. To accommodate the presence of the first packet, the wrapping arms during wrapping of the second packet are moved through paths that are spaced a slightly greater distance from the arbor than the spacing from the arbor of the paths followed during wrapping of the first packet.

This adjustment in the path of movement of the wrapping arms is effected by a suitable control that includes means for sensing the outside dimensions of the core after each packet is wrapped about arbor 50. In the same manner as during the first wrapping operation, the clamping fingers 135, 136 and 137 and 145, 146 and 147 are retracted as the packet ends move through their respective locations and are quickly returned to their clamping positions as the packet ends move past these locations. The first packet remains snugly wrapped about the arbor despite this brief withdrawal of the fingers because the belt 90 is still embracing the wrapped core form and holding the core form in its wrapped condition during this interval.

The second packet is positioned with respect to the first packet in such a way that the first step, or joint, of the second step pattern is located generally in radial alignment with the first step, or joint, of the first step pattern, and the last step of the second step pattern is located generally in radial alignment with the last step of the first step pattern, as is illustrated in FIG. 16. Step patterns arranged in substantially this manner are disclosed in our aforesaid U.S. Pat. No. 4,734,975 (FIGS. 1*a* and 1*b*) and in the aforesaid U.S. Pat. No. 4,741,096—Lee and Ballard (FIGS. 2 and 3).

The above-described steps of cutting groups 19 from the composite strip 12, assembling packets 52 from the groups, and wrapping the packets in superposed relationship about the arbor 50 is repeated over and over again until a core form of the desired thickness, or build, is obtained. The additional packets that are wrapped after the first two are so positioned that their step lap patterns are located generally in radial alignment with the step lap patterns of the first two packets. All of these step lap patterns, as well as the individual lap joints, are located in angular alignment with the concave surface portion 130 of the arbor 50. The joint region of the full-thickness core form has a progressively increasing length proceeding from the window to the outer periphery of the core form, just as shown in FIG. 2 of the aforesaid Lee and Ballard patent.

BLOCKING ROTATION OF THE ARBOR 50 DURING WRAPPING, BUT INDEXING THE ARBOR AWAY FROM THE TABLE EDGE 69 AS WRAPPING PROCEEDS

It is to be noted that during each of the wrapping operations the arbor remains essentially stationary. There is no rotation of the arbor, as is the case in some prior belt-type wrapping machines. This absence of arbor-rotation is significant because rotation of the arbor often produces forces on the laminations being wrapped that act longitudinally of the laminations and thus tend to dislocate the laminations peripherally of the arbor. Such longitudinally-acting forces would be especially undesirable in a wrapping operation in which many laminations are being wrapped simultaneously (which is, in fact, the case in our wrapping operation) since each group of amorphous metal strips comprises many strips which at this stage are not bonded together and each packet contains many groups of strips, which groups at this stage are not bonded together.

Although we block our arbor from rotating during wrapping, we do move the arbor transversely away from the edge 69 of the table 64 just prior to each packet being placed upon the table ledge 68 in preparation for a packet-wrapping operation. In FIG. 4, the arbor is shown spaced from the edge 69 by the thickness of one packet 52. After this first packet 52 has been fully wrapped about the arbor, the arbor is incrementally moved to the left by a hydraulic actuator 150 (FIG. 4), which moves the arbor by an amount equal to the thickness of the next packet 52 that is to be wrapped about the arbor. After each packet is wrapped about the arbor, the actuator 150 acts as an indexing device, moving the arbor to the left by an amount equal to the thickness of next packet to be wrapped. Such leftward indexing motion assures that there will always be space on the ledge 68 for the next packet that is laid thereupon in preparation for wrapping.

Referring to FIG. 4, the hydraulic actuator 150 comprises a piston 151 and a piston rod 152 coupled to the piston and extending through a horizontally-extending passage in the table 64 beneath its upper surface 65. The right hand end of the piston rod is suitable coupled to a vertically-extending shaft 153 that is connected at its upper end to the arbor 50. The table 64 is suitably grooved to receive the vertical shaft 153 and permit its horizontal translation when driven by the actuator 150.

It is to be noted that the clamping fingers 135–147 are also moved to the left, as viewed in FIGS. 4 and 8*a*, when the arbor 50 is indexed to the left by its actuator 150 of FIG. 4. To allow for such movement of the clamping fingers, the clamping fingers are mounted on an auxiliary table (not shown) which is mounted on main table 64. This auxiliary table is moved to the left concurrently with leftward indexing movement of the arbor 50, being so moved by a distance equal to approximately twice that of the arbor movement plus an amount equal to the extra build that occurs in the joint region of the core form. This movement of the auxiliary table, in effect, compensates for auxiliary movement of the arbor and the core build on the back side of the arbor.

APPLYING INNER AND OUTER SHELLS AND RESHAPING THE CORE FORM

Referring now to FIG. 10, after a sufficient number of packets 52 have been sequentially wrapped about arbor 50 to obtain the desired core build, an outer wrapper, or shell, 160, preferably comprising a 10 mil thick strip of silicon steel of a length greater than the perimeter of the core form, is placed about the core form, and its overlapping ends are appropriately secured together. Our outer wrapper is preferably constructed as shown and claimed in U.S. Pat. No. 4,024,486—Klappert, assigned to the assignee of the present invention. This wrapper has overlapping ends secured together by a tab 162 formed in one end and extending through an aligned slot in the other end, with the tab bent back to hold the ends in secured relationship.

It is to be understood that the core form is suitably held in snugly embracing relationship with the arbor 50 while the outer wrapper 160 is being applied, thus maintaining this relationship during and immediately after application of the outer wrapper.

Figure 11:
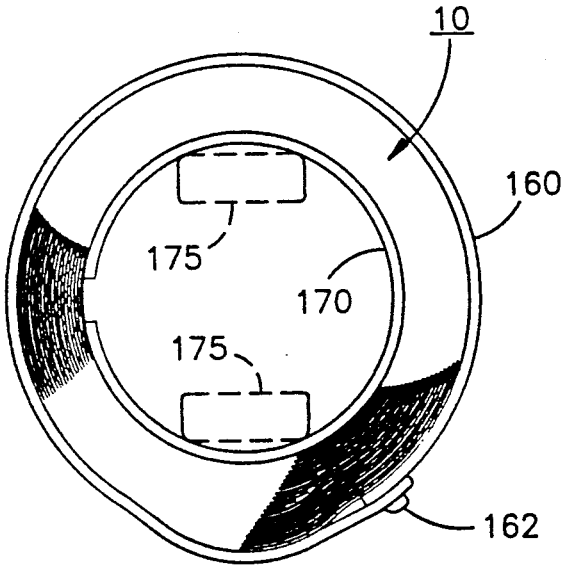
FIG. 11 shows the core form after it has been removed from the arbor and expanded into a generally circular, or toroidal, form.

As a next step, the core form with the outer wrapper 160 in place is lifted off the arbor. Immediately thereafter, a rolled-up sheet 170 (shown in FIG. 11) of stainless steel about 20 mils in thickness and normally flat, is placed within the core window in the space formerly occupied by the arbor. This rolled-up sheet, which has its ends unjoined, then returns through its natural resilience toward its original flat condition, thus expanding the core form into an approximately circular shape, as shown in FIG. 11. The presence of this stainless steel sheet snugly fitting within the core window enables the core form to be handled during subsequent steps without collapsing internally, which it would otherwise tend to do because the amorphous metal strips of the core form have little hoop strength to resist such collapse.

When the inner stainless steel sheet 170 expands toward its circular form as above described, the outer wrapper also expands into an approximately circular form since it has flexibility at this stage. Expansion of the core form into a circular shape as above described causes some slight shifting of the ends of each group longitudinally of the group, slightly reducing the amount of overlap between these ends. But this reduction in overlap amounts to only several mils, as compared to the normal full overlap of about ½ inch, and this relatively small reduction is not very significant.

Referring to FIG. 10, it is to be noted that the core form has an inwardly projecting bump on its inner periphery while it is still on the arbor 50, this bump being located in the depression adjacent the concave front surface 130 of the arbor 50. But when the core form is expanded into its circular configuration, as above described, this bump is, in effect, shifted from the inner to the outer periphery of the core form.

Next, the core form is reshaped by a conventional reshaping operation that involves, first placing the core form on two suitable forming elements (shown in dotted lines at 175 in FIG. 11) that extend through its window. These forming elements are then forced apart to shape the core form into the rectangular configuration shown in FIG. 12. The inner and outer shells 160 and 170, as well as the amorphous strips, are shaped during this shaping operation into rectangular configurations. During the shaping operation, the inner shell serves as a buffer layer effective in preventing damage to the innermost strips of the core as the core is engaged by the forming elements; and the outer shell serves as a buffer layer for protecting the outermost core strips. Similar inner and outer shells are disclosed and claimed in our aforesaid U.S. Pat. No. 4,734,975.

ADDITIONAL FEATURES OF THE WRAPPING OPERATION

It will be noted that our wrapping operation is carried out by, in effect, folding the packets 52 about the arbor 50 or about the previously laid-down core form. The mid-section of each packet 52 is first clamped to the back side of the effectively stationary arbor, and the ends of the packet are then folded about the ends 120 and 122 of the arbor. During this folding operation, there is no rotation of the arbor or exertion of appreciable longitudinal forces on the strips, each of which actions would have a tendency to cause the strips or groups of strips to slide on one another longitudinally of the strips, undesirably displacing their ends out of the precise locations desired for them.

The folding action referred to in the immediately preceding paragraph is characterized by the following relationships during wrapping of a packet by the belt: (i) no substantial relative movement between the belt 90 and the outside group 19 of the packet being wrapped and (ii) by no substantial relative movement at engaging surfaces of the inside group 19 of the packet relative to the arbor or to the embraced core form once engagement occurs between the inside group and the arbor or the embraced core form. The first of these relationships helps to prevent any displacement of the outer group by the belt, and the second of these relationships helps prevent any sliding of the inside group on the arbor or the embraced core form, thus avoiding any undesired displacements of the strips or groups that might otherwise result from such sliding.

Other factors tending to prevent undesired longitudinal displacement of the strips or groups of strips during the wrapping operation are (1) the clamping early in the wrapping operation of the midsection of each packet to the back side of the arbor 50 by clamping means 100, as described hereinabove and (2) holding the arbor against rotation, as described hereinabove.

It is to be further noted that we are able to carry out our wrapping operation without special edge guides for the strips or groups of strips. The only edge guiding that we use during the wrapping operation is derived from the horizontal top 65 of the table 64 on which the arbor 50 is located. This table top, by forming a surface on which the lower edges of the strips can bear, supports the strips during the wrapping operation.

Another important feature is that we can carry out our wrapping operation and the strip-handling operations preceding the wrapping operation without wetting the strips or groups of strips with any liquid. Such a liquid has been found helpful in holding the strips together by a surface tension effect, but the presence of liquid can introduce environmental problems in the case of easily-evaporable liquids, such as perchloroethylene, or corrosion problems in the case of other liquids, such as water. By dispensing with such liquids, we can eliminate such problems. We are able to proceed without these liquids because we utilize the features described hereinabove for reducing the tendency of the strips to slide longitudinally on one another during the wrapping operation.

The elongated configuration of the arbor 50 in the direction of its width also plays a significant role in enabling the wrapping operation to be carried out in the manner described hereinabove. The arbor, it is noted, has a substantially greater width dimension (i.e., the dimension extending between its ends 120 and 122) than its depth dimension (extending between its back and front faces).

Elongation of the arbor in this width direction helps to assure that there is radially-inwardly acting force on the strips throughout the portion of their length not clamped by the fingers 35, 36, 37, 45, 46, 47, thus increasing the tightness of the strips about the arbor. If the arbor was elongated in a direction perpendicular to its illustrated width dimension, there would be much reduced radially-inwardly acting force on the strips along the sides of the core form bordering these elongated sides. The rounded and convex configuration of the arbor at its ends 120 and 122 also helps to assure that there is radially-inward action force on the strips along these entire end regions. Similarly, the convex configuration of the arbor on its back side helps to assure that there is radially-inwardly acting force on the strips in this region. It will be apparent that the arbor is of a convex configuration at all points on it periphery except on its concave front face 130, where the fingers 135–147 are able to exert radially-inwardly acting force.

The belt 90, when it fully embraces the arbor 50 or core form 10, helps assure tightness of the packets on the arbor by, in effect, squeezing the packets between the belt and the arbor. This action is facilitated by the convex configuration of the arbor in all regions of it periphery except on its concave front face 130, where the fingers 35–47 are holding the packets tight against the arbor.

Because the arbor is concave on its front side, there is no significant outwardly projecting bump developed on the core form in the adjacent joint region while the core form is being built up. While the concavity on the front face of the arbor does cause a radially-inwardly projecting bump to be present on the core in its joint region, this type of bump does not cause the problems that the gradually-increasing radially-outwardly projecting bump causes, as will soon be explained.

Figure 13:
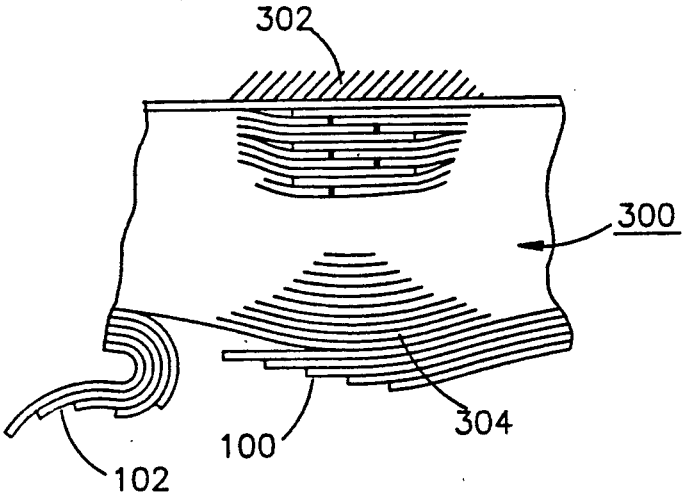
FIG. 13 is a diagrammatic view illustrating an undesirable condition that could develop during wrapping if the arbor did not include a concavity on its back face.

Referring to FIG. 10, while the illustrated core form does develop a greater thickness in the joint region than elsewhere as it is built up, this thickening has the effect of progressively reducing the extent to which the packets bow radially inwardly in the joint region as the core form builds up. By the time the radially-outwardly-located packets are being wrapped, there is no inwardly-projecting bow developed in the packets in the joint region. These packets extend via substantially straight line paths in the joint region. In some case (not illustrated), there may even be a very slight outward bow in these packets in their joint region, but this bow is not pronounced enough to cause the kind of problems that would be caused by the more typical, and much more pronounced, outwardly-projecting bump associated with lap joint constructions that do not use the short-sheet approach referred to hereinabove under "Background". In our studies leading up to the present invention, we have investigated the use of a stationary arbor similar to that shown but without a depression comparable to our depression 131, and we have wrapped packets therearound in the general manner herein described to form a core form having the usual outwardly-projecting bump. Such a core form is illustrated in FIG. 13, where the core form is designated 300, the arbor 302, and the bump 304. We have found that the presence of the relatively large outwardly projecting bump (304) causes the extreme ends 100 of the strips at the first laid-down end 100 of the packet 52 to project from the surface of the bump. When an attempt is made to lay down the other end 102 of the packet atop the first end 100, the two ends have often become tangled and undesirable wrinkles often develop in the amorphous steel strips in this region. By eliminating the presence during the wrapping operation of an outwardly projecting bump, we are able to greatly reduce this wrinkling tendency.

It is further noted that the relative wideness of the arbor 50 in the x direction enables all joints to be located in registry with the concave face 130 of the arbor. This is desirable because if the joints were located in registry with a convex portion of the arbor, the extreme ends of the strips in this region would tend to project away from the adjacent arbor surface and to cause the wrinkling problem referred to in the immediately-preceding paragraph.

It will be apparent from the above description that our core form is built up by sequentially, or consecutively, wrapping about a static arbor (50) packets (52) of amorphous metal strips, each packet comprising a plurality of longitudinally-staggered groups (19) of strips. This approach enables an exceptionally large number of strips to be wrapped with each wrapping operation of the wrapping arms (72, 74 and 76, 78), thus shortening the time required for wrapping the full core form as compared to the time required by methods in which individual groups are wrapped one at a time. The following prior patents disclose wrapping amorphous metal strips in groups one at a time: U.S. Pat. No. 4,413,406—Bennett and Ballard; U.S. Pat. No. 4,741,096—Lee and Ballard; and our U.S. Pat. No. 4,734,975. In the core-making methods of these patents, the packets are not assembled before being wrapped but rather are assembled on the arbor itself. There is a U.S. Pat. No. 3,049,793—Cooper et al which discloses assembling packets before wrapping them about an arbor, but the strips in these packets are traditional silicon steel strips and are not assembled in groups, and furthermore, the Cooper et al arbor rotates during wrapping of its packets, which, as explained hereinabove, has a tendency to displace the ends of strips. The latter tendency would be especially troublesome if the strips were the relatively large number of thin amorphous metal strips that we employ.

There are also patents (such as U.S. Pat. Nos. 3,003,225—Zimsky et al and 4,709,471—Valencic et al)

which disclose making a transformer core by placing substantially all of the core laminations against an arbor and then wrapping or forming all of these laminations in unison about the arbor. This is a very different approach from our approach of sequentially, or consecutively, wrapping individual packets about the arbor. Our approach of sequentially wrapping packets enables lap joints readily to be formed between the opposed ends of the individual groups in a packet and also enables the groups, as the wrapping operation proceeds, to be cut to a controlled length to compensate for unpredictable variations that might develop in the tightness or overlap of groups wrapped at an earlier stage in the wrapping operation. A system for effecting such control of the length of the groups will now be described.

SENSING AND CONTROL SYSTEM 180 FOR CONTROLLING THE OVERLAP IN THE LAP JOINTS

Figure 14:
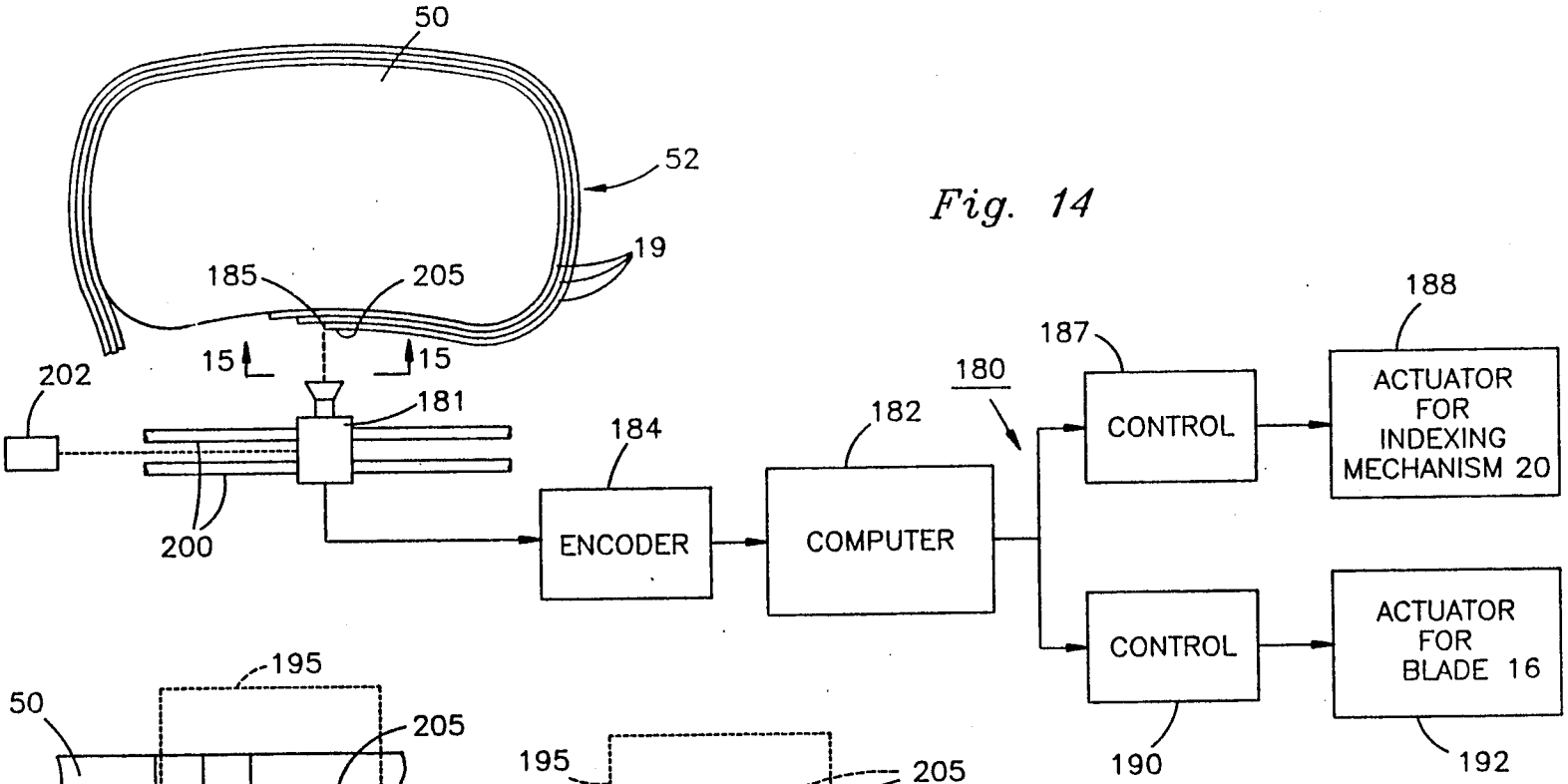
FIG. 14 is a schematic showing of a sensing and control system for controlling the amount of overlap provided in the lap joints of the core form as it is built up. In this figure, the core form is depicted at a time when a first packet has been partially wrapped about the arbor.

For a number of reasons there is a tendency for the overlap in the lap joints to vary. One such reason is that the amorphous metal strips typically have a thickness that varies somewhat along the length of the strips and from one strip to another between strips of the same nominal thickness. Another reason is that the space factor for each group and packet can vary somewhat for the above reason and also because of variations in the tightness of wrapping. The variation in the lap joint overlap is particularly undesirable if it results in a cumulative variation of the overlap from the desired constant value as the core build increases. To prevent this condition from occurring and to make the overlap in the lap joints generally constant throughout the core build, we provide the sensing and control system 180 schematically depicted in FIG. 14. This system comprises a conventional ccd (charge coupled device) camera 181 that senses the position of the two transversely extending edges of the outermost group 19 of each packet, a suitable computer of conventional form, and an encoder 184 for receiving the sensed information from the camera and for transmitting it to the computer in a suitable form for processing by the computer. The camera first senses the position of the leading transversely-extending edge (e.g. edge 185 in FIG. 14) of the last group in each packet when such edge is laid down, and this information is transmitted via the encoder 184 to the computer 182, where it is stored. This occurs before the left-hand end of the packet 52 is laid down. When the left-hand is thereafter laid down, the camera senses the precise position of the trailing edge 186 of the outer group, transmitting this information to the computer 182 via encoder 184. The computer then computes the difference between this last quantity and the stored quantity and this difference equals the overlap in the last joint.

If this overlap, as determined by the system 180, is short (as compared to the desired value of ½ inch in the present embodiment), the lengths of the groups for the next packet that is to be wrapped around the arbor are increased by an amount sufficient to compensate for deficiencies in the overlap of the measured packet. Similarly, if the measured overlap is long, the lengths of the groups for the next packet are decreased by an amount sufficient to compensate for the excess in overlap of the measured packet. To illustrate more specifically, the measured overlap is indicative of the then-present outer perimeter of the core form, and the computer can determine from the measure overlap and other stored data, the perimeter of the core form at the time of the overlap measurement. The computer then adds to this outer perimeter an amount equal to the desired overlap (i.e., ½ inch) plus n $2\pi t$, where n is the number of group in the next packet and t is the nominal thickness of each group; and this sum is the length to which the next group (which is the outermost group of the next packet) is to be cut. If the measured overlap is large, indicating a relatively short perimeter, then the sum, computed as described immediately hereinabove, is relatively small, thereby providing the desired shorter length of the next group to be cut, thus yielding the desired substantially constant overlap. These measuring and compensation actions are effected upon the wrapping of each packet, thus monitoring the overlap and maintaining it approximately constant throughout the core build.

It is to be understood that after the first group of the next packet is cut as described immediately hereinabove, succeeding groups of this packet are cut, each with a length shorter than the immediately preceding group by an amount $2\pi t$.

The computer 182 supplies input information to a control 187 for the actuator 188 for indexing means 20 (FIG. 3) and also to a control 190 for the actuator 192 for the shearing blade 16. The control 187 in response to this signal received from the computer causes the indexing means actuator 188 to operate the indexing means through sufficient travel to position the leading end of the composite strip 12 so that the next shearing operation by blade 16 cuts off a group 19 of the length required to provide the desired overlap.

Figure 15A:
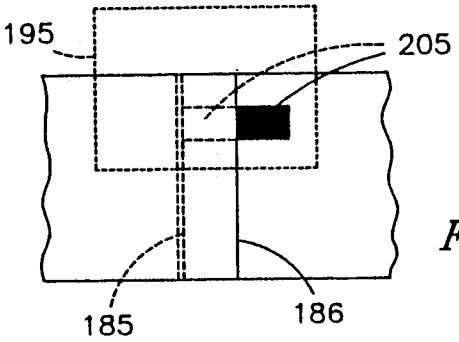
FIG. 15*a* is a view taken from the same location as FIG. 15 but after the first packet has been fully wrapped about the arbor.

As shown in FIG. 15*a*, the ccd camera has a field of view 195 that covers the area where the pertinent transversely extending edges of the outer group 19 are located. The camera is mounted on guide rails 200 (FIG. 14) along which the camera is shifted by suitable propulsion means 202 until the leading edge 185 of the group 19 becomes centrally located within the field of view 195, at which time motion of the camera is terminated and the camera senses the precise position of the edge 185, transmitting this information to the computer 182.

Figure 15:
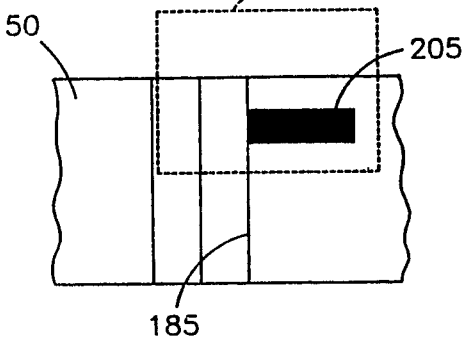
FIG. 15 is a view taken along the line 15—15 of FIG. 14.

To assist in the edge-recording operations and also in controlling motion of the camera 181 along its guide rails 200, the outer amorphous metal group 19 of each packet, which is actually the first group cut for the packet, is marked at its leading transversely-extended edge with a suitable quick-drying black ink, as shown of 205 in FIG. 15. This black ink marking 205 is an elongated mark that extends along the length of the outer group for a sufficient distance such that when this group is wrapped about the arbor 50, as shown in FIG. 9 and FIG. 15*a*, the mark 205 extends from the leading transversely-extending edge 185 past the trailing transversely-extending edge 186. When the right-hand end of the packet 52 is laid down against the arbor 50 and before the left-hand end is laid down atop it, the right-hand end of its packet, as seen by camera 181, has the appearance depicted in FIG. 15. When the camera 181 is moved to the right along the guide rails 200, it senses the presence of edge 185 marking this area of sharp contrast and develops a signal that is sent as a stop signal to its propulsion means 202. The camera also supplies the computer 182, as above described, with information as to the location of the edge 185, which information the computer stores. When the left-hand end of the packet 52 is thereafter laid down, the camera is presented with the view of FIG. 15*a*. As seen in FIG. 15*a*, there is a new area of sharp contrast (marked by edge 186) within the camera's field of view 195. The camera senses this new area of sharp contrast and sends to the computer information as to the location of the edge 186 marking this new area of sharp contrast. As previously noted, the computer then computes the difference between this last quantity and the first quantity and develops a signal representative of this difference, which signal is also representative of the overlap. After this computation has been made, the propulsion means is free to continue motion of the camera along the guide rails in preparation for the next set of edge-location recording events.

Figure 17:
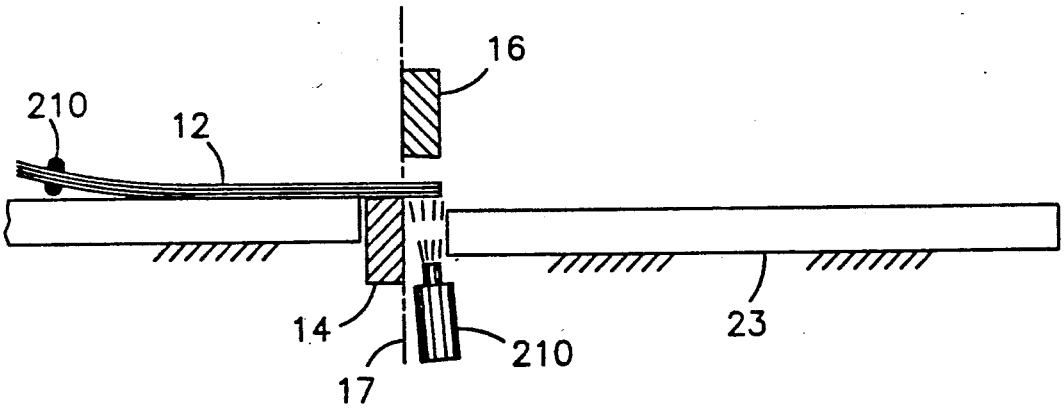
FIG. 17 is a view similar to that of FIG. 1 except showing the composite strip at an early stage in a strip-advancing operation when the leading end of the strip is being ink-sprayed.

The transversely-extending leading edge of each of the pertinent groups is marked as above-described by means of an ink-sprayer shown in FIGS. 1 and 17. The sprayer is positioned beneath the table 23 and is automatically operated at appropriate instants to mark the leading edge of the appropriate group. When this spraying takes place, the position of the composite strip 12 is under the control of upstream actuating means 210 shown schematically in FIG. 17. The upstream actuating means 210 acts, after a group 19 has been cut from strip 12, to advance the remainder of the composite strip 12 into a position where the composite strip can be grasped by the grasping means 26 of the indexing mechanism 20. This upstream actuating means 210 is controlled in such a manner that it first advances the composite strip into the position depcited in FIG. 17 and then pauses briefly before further advancing the composite strip. During this pause, the leading edge is ink-sprayed as shown in FIG. 17 to provided the mark 205.

While the camera, as described above, develops signals that are used for determining the overlap present in the outer group of each packet, it is to be understood that these signals can also be used to determine the location of the transversely-extending edges (e.g., 185 and 186) with respect to a fixed reference location on the arbor, e.g., the central bisecting plane 51 (FIG. 16). If these edges are not being accurately positioned with respect to reference plane 51 during the wrapping operation, then the control system 180 develops an error signal that is supplied to the control 187 for the indexing mechanism actuator 188, causing this actuator to make appropriate adjustments in the positions that the indexing mechanism 20 will deposit subsequently-cut groups on the bed 23 (FIG. 3). Such adjustments will cause the transversely-extending edges of these groups to be more correctly located with respect to reference plane 51, thus reducing the error signal to near zero.

ADDITIONAL STEPS IN MAKING A TRANSFORMER

Figure 12:
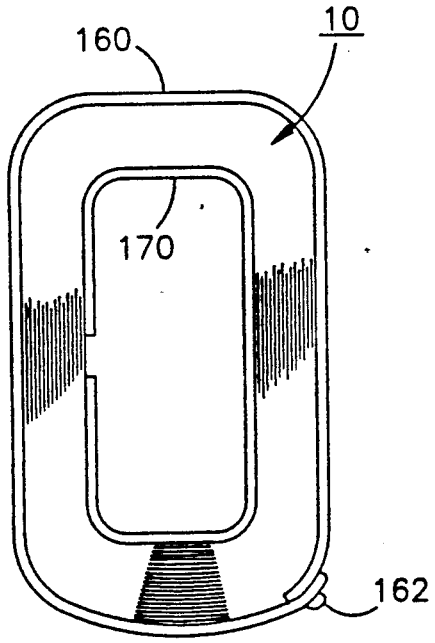
FIG. 12 is a plan view showing the core form after it has been reshaped to essentially its final configuration.

After the core form has been reshaped into the configuration shown in FIG. 12, it is further processed and then linked with a conventional tubular transformer coil in the manner disclosed and claimed in our aforesaid U.S. Pat. No. 4,734,975. More specifically, the core form is annealed; a bonding agent is applied to its sides to form a resilient coating bonding together the edges of the amorphous metal strips except in the yoke of the core where the joints are located; the core is opened at the joints to form a U-shaped structure having two elongated legs; one of these legs is slid through the window of the coil; and the core is then returned to its closed-joint condition. Of course, the core may be linked to more than one coil as shown in FIGS. 2–5 of our aforesaid U.S. Pat. No. 4,734,975, in which case, each of the legs of the U-shaped structure would be slid through the window of a coil before the core is returned to its closed-joint condition.

It is thus seen that the objects of the present invention set forth above, including those made apparent from the preceding description are efficiently attained and, since certain changes may be made in the above construction and method of achieving same without departing from the scope of the invention, it is intended that all matter contained in the above description or shown in the accompanying drawings shall be interpreted as illustrative and not in a limiting sense.

What is claimed as new and desired to secure by Letters Patent is:

1. A method of making a transformer core from strips of amorphous metal comprising:

(a) providing an arbor having a longitudinal axis and an external surface surrounding the axis and extending along the length of the arbor, the arbor having a transverse cross-section normal to said axis of a solid having an external perimeter including a surface portion having a concave configuration forming a depression in said perimeter, (b) providing a plurality of packets each comprising a plurality of groups of amorphous metal strips, each group comprising a plurality of elongated strips having substantially aligned longitudinally-extending edges and substantially aligned transversely-extending edges at opposite ends of the group, the groups in each packet having longitudinally-extending edges that are substantially aligned and transversely-extending edges at the ends of the packet that are staggered with respect to each other longitudinally of the packet, (c) wrapping said packets in superposed relationship about said arbor while holding the arbor against rotation thereby building up a core form about said arbor, and (d) locating each packet prior to its being wrapped around said arbor so that when the packet is wrapped about the arbor, opposite ends of each group within said packet meet in overlapping relationship in a location angularly aligned with said surface portion of concave configuration.

2. The method of claim 1 in which before said wrapping of a packet, the ends of successive groups in said packet, considered from the inside to the outside of the packet, overlap at one end of the packet and underlap at the opposite end of the packet.

3. The method of claim 1 in which except for said surface portion of concave configuration, the perimeter of said solid has a convex configuration, thus providing radial force on said packets at substantially all regions of said perimeter outside said concave surface portion when said packets are wrapped about said arbor.

4. The method of claim 1 in which said arbor perimeter is constituted by said concave surface portion, a back face on a side of said arbor opposite to the concave surface portion, and a plurality of ends interconnected to said back face and to said concave surface portion by rounded corner regions.

5. The method of claim 4 in which said arbor ends are of a convex configuration, thus providing radial force on said packets at said arbor ends when said packets are wrapped about said arbor.

6. The method of claim 1 in which:

(a) before wrapping, each packet is positioned between said arbor and a flexible belt located at a back side of said arbor opposite to the location of said concave surface portion, (b) said belt is wrapped about a first portion of said arbor thereby wrapping a portion of said packet about said first portion of the arbor and locating one end of said packet in angular alignment with said concave surface portion, and (c) said belt is wrapped about a second portion of said arbor thereby wrapping the remaining portion of said packet about said second portion of the arbor and locating the other end of said packet in angular alignment with said concave surface portion and in overlapping relationship with said one end of the packet.

7. The method of claim 1 in which wrapping of a packet about said arbor is effected by the following steps:

(a) wrapping a first portion of said packet about a first portion of the arbor that is in proximity to one end of said concave surface portion thereby locating one end of said packet in angular alignment with said concave surface portion; and (b) wrapping a second portion of said packet about a second portion of the arbor that is in proximity to the opposite end of said concave surface portion thereby locating the other end of said packet in angular alignment with said concave surface portion and in overlapping relation with the first end of the packet.

8. The method of claim 7 in which:

(a) said first portion of said packet is wrapped about said first portion of the arbor prior to the wrapping of said second portion of said packet about said second portion of the arbor, and (b) after wrapping of said first portion of said packet about said first portion of the arbor, said one end of said packet is clamped relative to said concave surface portion of the arbor while said second portion of said packet is being wrapped about said second portion of the arbor.

9. The method of claim 7 in which:

(a) step (a) of claim 7 is effected before step (b) of claim 7, and (b) said one end of the packet is clamped relative to said concave surface portion of the arbor while step (b) of claim 7 is being effected.

10. The method of claim 7 in which:

(a) step (a) of claim 7 is effected before step (b) of claim 7, (b) said one end of the packet is clamped relative to said concave surface portion of the arbor pwhile step (b) of claim 7 is being effected, and (c) after step (b) of claim 7, said second end of said packet is also clamped relative to said concave surface portion of the arbor, thereby clamping both ends of said packet to said arbor while the packet is in a fully wrapped condition.

11. The method of claim 1 in which as the core form is built up, succeeding packets are individually wrapped about the packet last wrapped about the arbor, each individual succeeding packet being wrapped by the following steps:

(a) wrapping a first portion of the packet about a first portion of the arbor that is in proximity to one end of said concave surface portion, thereby locating one end of the packet in angular alignment with said concave surface portion, and (b) then wrapping a second portion of the packet about a second portion of the arbor that is in proximity to the opposite end os said concave surface portion, thereby locating the other end of the packet in angular alignment with said concave surface portion and in overlapping relation with the first end of the packet.

12. The method of claim 11 in which for each packet wrapped about the arbor, after said first portion of the packet is wrapped, said one end of the packet is clamped with respect to said concave surface portion of the arbor while the second portion of the packet is being wrapped about said second portion of the arbor.

13. The method of claim 12 in which after each packet is fully wrapped about said arbor, both ends of the fully wrapped packet are clamped relative to said concave surface portion of the arbor.

14. The method of claim 1 in which:

(a) each packet prior to its being wrapped is positioned at a back side of said arbor opposite to the location of said concave surface portion and a mid-section of said packet is clamped to said back side of the arbor, and (b) extended portions of said packet on opposite sides of said clamped mid-section are respectively wrapped around opposite sides of said arbor.

15. The method of claim 6 in which: said mid-section of said packet together with a portion of said belt aligned with said mid-section are clamped to said back side of the arbor before said belt is wrapped about said first and second portions of said arbor.

16. A method of making a transformer core from strips of amorphous metal comprising following steps performed prior to assembly of the core with coil structure:

(a) providing an arbor having a longitudinal axis and an external surdace surrounding the axis;

(b) providing a first packet comprising a plurality of staggered groups of amorphous metal strips, each group comprising a plurality of said strips, and each strip having a length bounded by two spaced apart transversely-extending edges;

(c) wrapping said first packet to a wrapped position about said external surface of said arbor while holding said arbor against rotation relative to said first packet;

(d) providing holding means for hoding said first packet in said wrapped position;

(e) engaging said first packet with said holding means to hold said first packet in said wrapped position;

(f) providing a second packet comprising a plurality of staggered groups of amorphous metal strips, each group comprising a plurality of said strips, and each strip having a length bounded by two spaced apart transversely-extending edges;

(g) wrapping said second packet to a wrapped position about said first packet and said external suface of said arbor; and (h) engaging said second packet with said holding means to hold said first and second packets in said wrapped positions.

17. The method of claim 16 further comprising the steps of:

(a) providing means for sensing a first parameter of said first packet indicative of the location when said first packet is wrapped about the external surface of said arbor of one of said transversely-extending edges of a strip in said first packet, (b) sensing said first parameter with said sensing means, and (c) controlling a subsequent step of said method in response to information derived from said sensing of said first parameter.

18. The method of claim 17 wherein said subsequent step comprises the step of providing said second packet, which includes the step of cutting at least one of said amorphous metal strips in said second packet to a controlled length in response to information derived from said sensing of said first parameter.

19. The method of claim 17 wherein the step of providing sensing means includes the step of providing means for sensing the position of said transversely-extending edges of one of the strips in said first packet when said first packet is in said wrapped position.

20. The method of claim 19 wherein said subsequent steps includes said cutting step, which includes cutting said at least one of said amorphous metal strips in said second packet to said controlled length in response to information derived from said sensing of the position of said transversely-extending edges of one of said strips in said first packet.

21. The method of claim 16 wherein the step of providing said arbor includes the step of providing an arbor with an external surface at least a portion of which is concave.

22. The method of claim 21 wherein the steps of wrapping said first and second packets includes wrapping said first packet so that at least a portion of said first packet is overlapped on itself and wrapping said second packet so that at least a portion of said second packet is overlapped on itself.

23. The method of claim 22 wherein the steps of wrapping said first and second packets includes wrapping said first and second packets about said arbor to effect disposition of said overlapped portions of said first and second packets adjacent said concave surface portion.

24. A method of making a transformer core from strips of amorphous metal comprising the following steps performed prior to assembly of the core with coil structure:

(a) providing a plurality of amorphous metal strips in superposed and aligned relationship to form a first group of amorphous metal strips, said first group having a first predetermined length and having first and second spaced apart transversely-extending edges;

(b) providing a plurality of amorphous metal strips in superposed and aligned relationship to form a second group of amorphous metal strips, said second group having a second predetermined length and having first and second spaced apart transversely-extending edges;

(c) disposing said second group adjacent said first group to form a packet of amorphous metal strips wherein the transversely-extending edges of said second group are offset from the transversely-extending edges of said first group;

(d) providing an arbor having a longitudinal axis and an external surface surrounding said axis;

(e) thereafter, wrapping said packet to a wrapped position about said external surface of said arbor.

25. The method of claim 24 wherein said wrapping step includes wrapping said packet about said arbor to a wrapped position wherein said packet is overlapped on itself.

26. The method of claim 25 wherein said wrapping step includes wrapping said packet about said arbor to a wrapped position wherein said first group is overlapped on itself and said second group is overlapped on itself.

27. The method of claim 24 further comprising the steps of:

(a) providing a plurality of amorphous metal strips in superposed and aligned relationship to form a third group of amorphous metal strips, said third group having a third predetermined length and having first and second spaced apart transversely-extending edges;

(b) providing a plurality of amorphous metal strips in superposed and aligned relationship to form a fourth group of amorphous metal strips, said fourth group having a fourth predetermined length and having first and second spaced apart transversely-extending edges;

(c) disposing said fourth group adjacent said third group to form a second packet wherein the transversely-extending edges of said fourth group are offset from the transversely-extending edges of the third group; and (d) thereafter, wrapping said second packet about said first packet and said external surface of said arbor.

28. The method of claim 27 further comprising the steps of:

(a) providing means for sensing a first parameter of said first packet indicative of the location when said first packet is wrapped about said external surface of said arbor of one of said transversely-extending edges of a strip in said first packet, (b) sensing said first parameter with said sensing means, and (c) controlling a subsequent step of said method in response to information derived from said sensing of said first parameter.

29. The method of claim 28 wherein said subsequent step comprises providing the metal strips of said second packet, which includes the step of cutting at least one group of the strips in said second packet to a controlled length in response to information derived from said sensing of said first parameter.

30. The method of claim 29 wherein the step of sensing includes the step of sensing the position of the transversely-extending edges of one of the strips in said first packet.

31. A method of making a transformer core from strips of amorphous metal comprising the steps of:

(a) providing a table that has a substantially horizontal top surface and an edge at one side of said surface, (b) providing an arbor projecting upwardly from said table top surface and having a substantially vertical longitudinal axis and an external surface surrounding the axis that includes a front face and a back face for the arbor, the arbor having its back face spaced from said edge of the table, (c) providing first and second packets, each comprising a plurality of strips of amorphous metal, each strip having longitudinally-extending edges and opposed ends, (d) placing said first packet adjacent the back face of the arbor with the longitudinally-extending edges of its strips resting on the table top in a location between said back face and said edge, (e) wrapping said first packet about said arbor so that the opposed ends of its strips are located adjacent to the front face of the arbor, (f) after said first packet has been placed adjacent said arbor, moving said arbor away from said table edge to make room on said table top for said second packet, (g) placing said second packet on said table top with the longitudinally-extending edges of the strips of said second stack resting on said table top and said second packet being located between said table edge and the outside of said wrapped first packet, and (h) wrapping said second packet about said arbor so that the opposed ends of its packets are located adjacent to the front face of said arbor.

32. The method of claim 31 in which:

(a) additional packets comprising elongated amorphous metal strips having longitudinally-extending edges and opposed ends are wrapped in sucession about the outer surface of a preceding packet of strips already wrapped about said arbor, (b) each of said packets is placed on said table top prior to its being wrapped in a location between said table edge and the back surface of said arbor, and (c) after each packet is wrapped around the arbor, the arbor is moved away from the table edge by an amount sufficient to make room on the table top for the immediately succeeding packet to be placed on said table as in (b) of this claim.

33. A method of making a transformer core from strips of amorphous metal comprising:

(a) providing an arbor having a longitudinal axis and an external surface surrounding the axis and extending along the length of the arbor, the arbor having a transverse cross-section normal to said axis of a solid having an external perimeter including a surface portion having a concave configuration forming a depression in said perimeter, (b) providing a plurality of groups of amorphous metal strips, each group comprising a plurality of elongated strips having substantially aligned longitudinally-extending edges and substantially aligned transversely-extending edges at each end of the group, (c) wrapping said groups about said arbor in superposed relationship while holding the arbor against rotation, thereby building up a core form about said arbor, and (d) locating each group adjacent the arbor prior to its being wrapped around the arbor in such a position that when the group is wrapped around the arbor, opposite ends of the group meet in overlapping relationship in a location angularly aligned with said surface portion of concave configuration.

34. The method of claim 33 in which:

(a) each group prior to its being wrapped is positioned at a back side of said arbor opposite to the location of said concave surface portion and a mid-section of said group is clamped to said back side of the arbor, and (b) extended portions of said group on opposite sides of said clamped mid-section are respectively wrapped around opposite ends of said arbor.

35. The method of claim 33 in which except for said surface portion of concave configuration, the perimeter of said solid has a convex configuration, thus providing radial force on said packets at substantially all regions of said perimeter outside said concave surface portion when said packets are wrapped about said arbor.

36. The method of claim 33 in which said arbor perimeter is constituted by said concave surface portion, a back face on a side of said arbor opposite to the concave surface portion, and a plurality of ends interconnected to said back face and to said concave surface portion by rounded corner regions.

37. The method of claim 33 in which said arbor ends are convex configuration, thus providing radial force on said packets at said arbor ends when said packets are wrapped about said arbor.

38. The method of claim 33 in which:

(a) before wrapping, a plurality of said groups is positioned in a stack between said arbor and a flexible belt located at a back side of said arbor opposite from the location of said concave surface portion, (b) said belt is wrapped around a first portion of said arbor, thereby wrapping a portion of said stack about said first portion of the arbor and locating one end of said stack in angular alignment with said concave surface portion; and (c) said belt is wrapped around a second portion of said arbor, thereby wrapping the remaining portion of said stack about said second portion of the arbor and locating the other end of said stack in angular alignement with said concave surface portion and in overlapping relationship with said one end of the packet.

39. The method of claim 38 in which:

(a) step (a) of claim 38 is effected before step (b) of claim 38, and (b) said one end of the stack is clamped relative to said concave surface portion of the arbor while step (b) of claim 38 is being effected.

40. The method of claim of 38 in which:

(a) step (a) of claim 38 is effected before step (b) of claim 38, (b) said one end of the stack is clamped relative to said concave surface portion of the arbor while step (b) of claim 38 is being effected, and (c) after step (b) of claim 38 is effected, said second end of said stack is also clamped relative to said concave surface portion of the arbor, thereby clamping both ends of said stack to said arbor while the stack is in fully wrapped condition.

41. The method of claim 38 in which as the core form is built up, succeeding stacks are individually wrapped about the stack last wrapped about the arbor, each individual succeeding stack being wrapped by the following steps:

(a) wrapping a first portion of the stack about a first portion of the arbor that is in proximity to one end of said concave surface portion, thereby locating one end of the stack in angular alignment with said concave surface portion, and (b) then wrapping a second portion of the stack about a second portion of the arbor that is in proximity to the opposite end of said concave surface portion, thereby locating the other end of the stack in angular alignment with said concave surface portion and in overlapping relation with the first end of the stack.

42. The method of claim 41 in which for each stack wrapped about the arbor, after said first portion of the stack is wrapped, said one end of the stack is clamped with respect to said concave surface portion of the arbor while the second portion of the stack is being wrapped about said second portion of the arbor.

43. The method of claim 42 in which after each stack is fully wrapped about said arbor, both ends of the fully wrapped stack are clamped relative to said concave surface portion of the arbor.

44. A method as defined in claim 33 and further comprising: (a) providing holding means for holding said plurality of groups in said wrapped position, (b) engaging said plurality of groups with said bolding means to hold said plurality of group in said wrapped position, (c) providing an additional plurality of groups of amorphous metal strips, (d) wrapping said additional plurality of groups about said first plurality of groups and causing the opposite ends of said additional plurality of groups to meet in overlapping relationship in a location angularly aligned with the arbor surface portion of concave configuration, (e) developing information indicative of the location of the transversely-extending edges of at least one of the groups in said first plurality of groups when said first plurality of groups is wrapped about said arbor, and (f) controlling responsive to said developed information the length of the groups in said additional plurality of groups as a function of the location of said transversely-extending edges of (e).

45. The method of claim 44 wherein the controlling step of (f), claim 44, includes the step of cutting the groups of said additional plurality of groups to lengths that render the overlap in the joints of the additional plurality substantially equal to that of said one group in the first plurality.

46. The method of claim 1 in which said arbor has a back side opposite to the location of said concave surface portion and has two end portions located between said concave surface portion and said back side, the distance between said two end portions defining the width of the arbor and being substantially greater than the distance between said back side and said concave surface portion so that said arbor is elongated in the direction of its width and so that the core form wrapped about the arbor is elongated in a corresponding direction.

47. The method of claim 46 in which:

(a) said core form is removed from said arbor after its build has been increased to a desired value by the wrapping of said packets about said arbor, and (b) said core form is then reshaped so that: (i) it is elongated in a direction substantially perpendicular to its direction of elongation while positioned on said arbor and (ii) the joints formed where said groups overlap are located in a relatively short side of said reshaped core form.

48. A method of making a transformer core from (a) assembling on a carrier a packet comprising groups of amorphous metal strips, each group comprising a plurality of elongated strips having longitudinally-extending edges and substantially aligned transversely-extending edges at opposite ends of the group, the groups in said packet having transversely-extending edges that are staggered with respect to each other longitudinally of the packet, the assembly being carried out in such a way that the longest group in said packet is disposed adjacent said carrier and progressively shorter groups are successively disposed atop said longest group, (b) fixing said packet to said carrier with the packet assembled thereon as specified in (a), (c) providing an arbor having a longitudinal axis and an external surface surrounding said axis, the external surface including a back and a front face for said arbor, (d) placing said carrier adjacent said back face, with the packet: (i) fixed on said carrier as specified in (b), (ii) positioned between said carrier and said back face, with the shortest group of said packet closest to said back face, and (iii) having a mid-section in alignment with the back face and having extended portions terminating in ends disposed on opposite sides of each mid-section, (e) after step (d) releasing said packet from said carrier and wrapping said extending portions of said packet about the arbor so that the ends of said packet meet adjacent said front face, (f) holding said arbor against rotation about its longitudinally axis while said extended portions of the packet are being wrapped about the arbor.

49. The method of claim 48 in which said packet mid-section is clamped to said back face of the arbor while said extended portions of the packet are being wrapped about the arbor.

50. A method of making a transformer core from strips of amorphous metal comprising the steps of:

(a) providing an arbor having a longitudinal axis and an external surface surrounding the axis;

(b) providing a first packet comprising a plurality of amorphous metal strips, each strip having a length bounded by two spaced apart transversely-extending edges;

(c) wrapping said first packet to a wrapped position about said external surface of said arbor while holding said arbor against rotation relative to said first packet;

(d) providing holding means for holding said first packet in said wrapped position;

(e) engaging said first packet with said holding means to hold said first packet in said wrapped position;

(f) providing a second packet comprising a plurality of amorphous metal strips each having a length bounded by two spaced apart transversely-extending edges;

(g) wrapping said second packet to a wrapped position about said first packet and said external surface of said arbor; and (h) engaging said second packet with said holding means to hold said first and second packets in said wrapped positions, and in which:

(i) a core form is built up as said packets are wrapped about the arbor, (j) the outermost strip in said first packet when said first packet is wrapped about said arbor has an outer surface, (k) said outermost strip has an intermediate zone and two end zones each extending from said intermediate zone to one of said transversely-extending edges, the end zones being wrapped in succession about said arbor and overlapping adjacent their transversely-extending edges when said first packet is wrapped about the arbor, (l) there is provided at one of said transversely-extending edges of said outermost strip a mark that produces constrasting shades on opposite sides of said edge as viewed from outside of said core form, (m) a sensor device sensitive to contrasting shades is caused to scan the outer surface of said core form after one of said end zones containing said mark has been wrapped about said arbor, thereby developing a signal indicative of the position of one of said transverse edges in response to scanning the contrasting shades at said one transverse edge, (n) said sensor device is caused to scan the outer surface of said core form after the other of said end zones has been wrapped about said arbor thereby developing a second signal indicative of the position of the other of said transverse edges, and (o) an output signal indicative of the overlap between said two end zones is derived by comparing said two signals.

51. The method of claim 50 in which said mark at said transversely-extending edge is produced by the following step: before said first packet is wrapped about said arbor, the outer surface of said outermost strip is marked so that when the end zone containing said mark is wrapped about said arbor, said contrasting shades appear on opposite sides of the marked transversely-extending edge of the outermost strip.

52. The method of claim 50 in which said mark at said transversely-extending edge is produced by the following step: marking the outer surface of said outermost strip with marking that extends from the transversely-extending edge of the first-wrapped end zone of said outermost strip past the location of the transversely-extending edge of the other of said end zones when said other end zone is wrapped about said arbor.

53. A method of making a transformer core from strips of amorphous metal comprising the following steps performed prior to assembly of the core with coil structure:

(a) providing an arbor having a longitudinal axis and an external surface surrounding the axis, (b) providing a plurality of packets each comprising a plurality of staggered groups of amorphous metal strips, each group comprising a plurality of elongated amorphous metal strips having substantially aligned longitudinally-extending edges and substantially aligned transversely-extending edges at opposite ends of the group, and (c) sequentially wrapping said packets in superposed relationship about said arbor.

54. The method of claim 53 further comprising the step of: locating each packet prior to its being wrapped around said arbor so that said wrapping step effects overlapping of said opposite ends of one of said groups in said pocket.

55. The method of claim 54 wherein said step of providing said arbor further comprises providing an arbor wherein said external surface includes a surface portion having a concave configuration, and said overlapping is effected at a location angularly aligned with said concave surface portion.

56. The method of claim 54 further comprising the steps of:

(a) providing means for sensing the amount of overlapping of the opposite ends of one of the groups in the first one of said packets when said packet is wrapped about said external surface of said arbor, (b) sensing said amount of overlapping with said sensing means, and (c) controlling a subsequent step of said method in accordance with said amount of overlapping.

57. The method of claim 56 wherein said subsequent step includes the step of cutting at least one of the groups in said second packet to a controlled length that is a function of said amount of overlapping sensed by said sensing means in said first packet.

58. The method of claim 53 further comprising the step of:

(a) providing flexible means, (b) disposing each said packet to be wrapped between said flexible means and said arbor, and (c) wrapping said flexible means about said arbor, thereby wrapping one of said packets about said arbor.

59. The method of claim 58 further comprising the steps of:

(a) unwrapping said flexible means from said arbor after each packet is wrapped about the arbor, (b) providing clamping means and utilizing said clamping means for clamping each wrapped packet to said arbor when said flexible means is unwrapped from said arbor.

60. The method of claim 53 wherein the groups in each packet have longitudinally-extending edges that are substantially aligned and transversely-extending edges at the ends of the packet, said transversely-extending edges of one of said groups being staggered with respect to the transversely-extending edges in the second of said groups.

61. The method of claim 53 further comprising the steps of:

(a) removing said sequentially wrapped packets from said arbor; and (b) reshaping said removed packets.

62. The method of claim 61 further comprising the step of: annealing said reshaped packets.

63. A method as defined in claim 62 in which the transversely-extending edges of each group meet at a joint when the group is wrapped about said arbor, the method further comprising the steps of:

(a) parting said annealed packets by separating said transversely-extending edges of each group at said joint;

(b) after said parting, assembling a transformer coil about said packets; and (c) rejoining said annealed packets by overlapping said opposite ends of each of said groups.

64. A method of making a transformer core from strips of amorphous metal comprising the following steps performed prior to assembly of the core with coil structure:

(a) providing an arbor having a longitudinal axis and an external surface surrounding the axis, (b) providing a plurality of packets each comprising a plurality of groups of amorphous metal strips, each group comprising a plurality of elongated amorphous metal strips having substantially aligned longitudinally-extending edges and substantially aligned transversely-extending edges at opposite ends of the group, and (c) sequentially wrapping said packets in superposed relationship about said arbor, and (d) holding said arbor against rotation during said wrapping step.

65. A method of making a transformer comprising coil structure and a core made from strips of amorphous metal, comprising:

(a) providing an arbor having a longitudinal axis and an external surface surrounding the axis, (b) providing a plurality of packets each comprising a plurality of staggered groups of amorphous metal strips, each group comprising a plurality of elongated amorphous metal strips having substantially aligned longitudinally-extending edges and substantially aligned transversely-extending edges at opposite ends of the group, (c) sequentially wrapping said packets in superposed relationship about said arbor, thereby building up a core form about said arbor, (d) removing said core form from said arbor, and (e) thereafter assembling said core form with said coil structure.

* * * * *

UNITED STATES PATENT AND TRADEMARK OFFICE

CERTIFICATE OF CORRECTION

PATENT NO. : 5,093,981

DATED : March 10, 1992

INVENTOR(S) : Donald E. Ballard and Willi Klappert

It is certified that error appears in the above-identified patent and that said Letters Patent is hereby corrected as shown below:

Column 1, line 21, the following should be deleted: "117"
Column 1, line 23, the number "4,741,093" should be changed to --4,741,096 --
Column 23, Claim 10, line 5, "pwhile" should be changed to --while --
Column 24, Claim 16, line 2, after "comprising" the following should be inserted-- the--
Column 24, Claim 16, line 6, "surdace" should be changed to --surface --
Column 27, Claim 35, line 4, "packets" should be changed to --groups --
Column 28, Claim 35, line 6, "packets" should be changed to --groups --
Column 28, Claim 37, line 3, "packets" (both occurrences) should be changed to --groups --
Column 28, Claim 39, line 2, "(a)" should be changed to --(b) --
Column 28, Claim 39, line 2, "(b)" should be changed to --(c) --
Column 39, Claim 39, line 6, "(b)" should be changed to --(c) --
Column 28, Claim 40, line 2, "(a)" should be changed to --(b) --
Column 28, Claim 40, line 2, "(b)" should be changed to --(c) --
Column 29, Claim 48, line 1, after "from" the following should be inserted -- strips of amorphous metal comprising the steps of: --

Signed and Sealed this

First Day of June, 1993

*Attest:*

Michael K. Kirk

MICHAEL K. KIRK

*Attesting Officer*

*Acting Commissioner of Patents and Trademarks*